US012790841B2

(12) United States Patent
Sturm

(10) Patent No.: US 12,790,841 B2
(45) Date of Patent: Nov. 10, 2026

(54) UNBOARDING DEVICE FOR A FORMWORK ELEMENT

(71) Applicant: PERI SE, Weissenhorn (DE)

(72) Inventor: Florian Sturm, Weissenhorn (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 18/841,143

(22) PCT Filed: Feb. 22, 2023

(86) PCT No.: PCT/EP2023/054361

§ 371 (c)(1),
(2) Date: Aug. 23, 2024

(87) PCT Pub. No.: WO2023/161246

PCT Pub. Date: Aug. 31, 2023

(65) Prior Publication Data

US 2025/0188754 A1 Jun. 12, 2025

(30) Foreign Application Priority Data

Feb. 24, 2022 (DE) ..... 10 2022 104 469.6

(51) Int. Cl.
*E04G 19/00* (2006.01)

(52) U.S. Cl.
CPC ..... *E04G 19/00* (2013.01)

(58) Field of Classification Search
CPC ..... E04G 19/00; E04G 17/001; E04G 11/10; B28B 7/30
See application file for complete search history.

(56) References Cited

U.S. PATENT DOCUMENTS 11,008,765 B2 * 5/2021 Johnson ..... E04G 13/02

FOREIGN PATENT DOCUMENTS

| | | | |
|---|---|---|---|
| AT | 51183 | E | 12/1911 |
| DE | 202005006645 | U1 | 7/2005 |
| DE | 102017222868 | A1 | 6/2019 |
| ES | 2352937 | A1 | 2/2011 |
| FR | 3055642 | A1 | 3/2018 |
| WO | 2019241784 | A1 | 12/2019 |

* cited by examiner

*Primary Examiner* — Lynn E Schwenning
(74) *Attorney, Agent, or Firm* — SLEMAN & LUND LLP

(57) ABSTRACT

An unboarding device for a formwork element that includes a base element, a tension/compression rod, and at least one boarding/unboarding element to extend or retract the at least one boarding/unboarding element coupled laterally with the base element through a linear movement of the tension/compression rod essentially parallel to its rod axis relative to the base element into a boarding or unboarding position. A method for boarding and unboarding the formwork element.

14 Claims, 12 Drawing Sheets

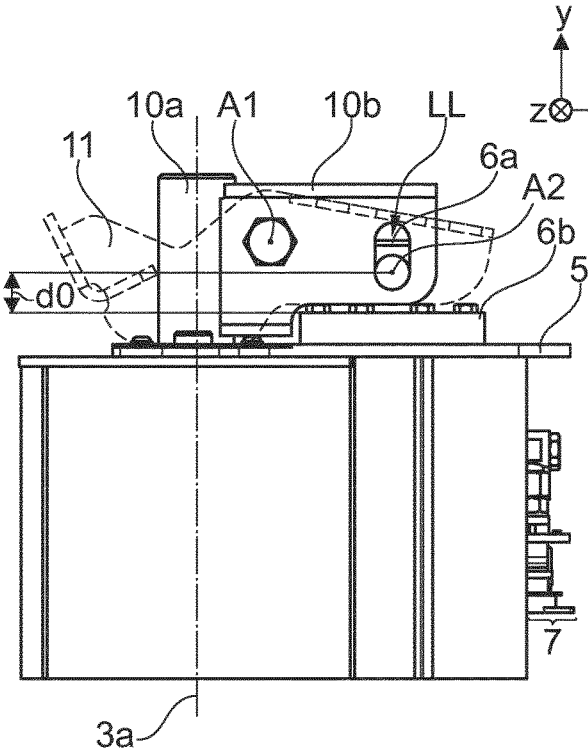
Fig. 7a
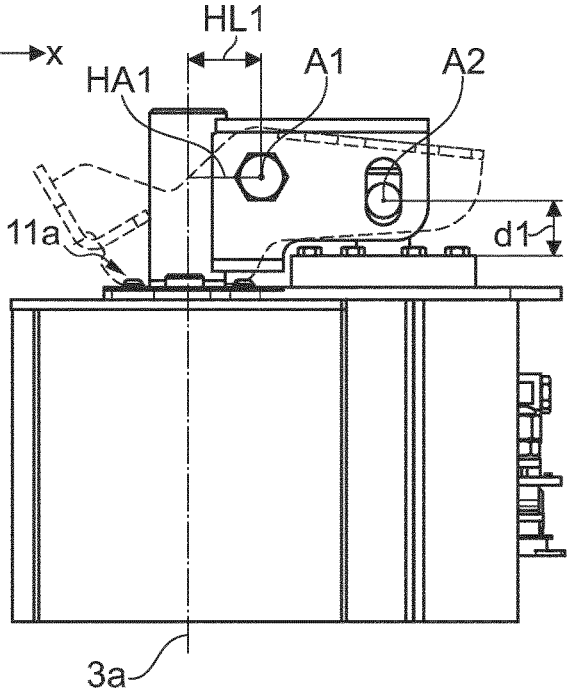
Fig. 7b
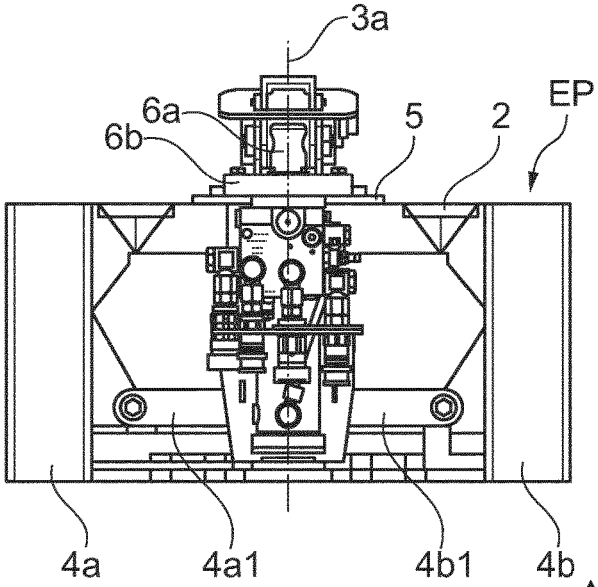
Fig. 7a'
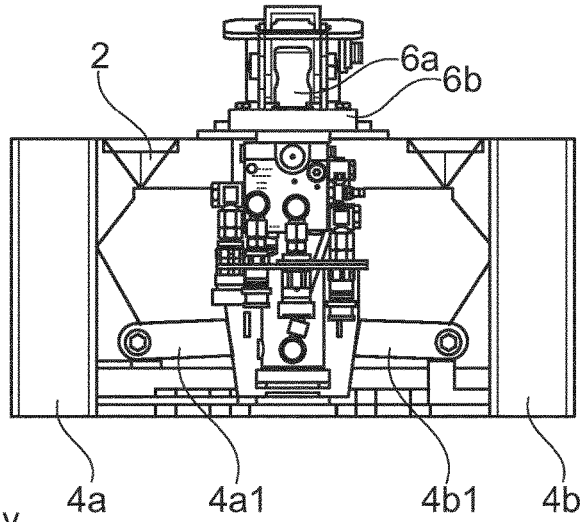
Fig. 7b'
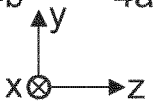

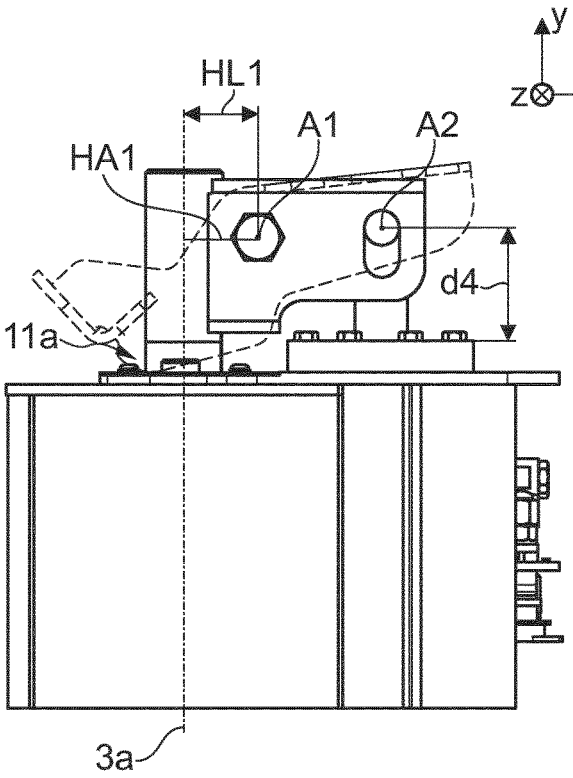
Fig. 7e
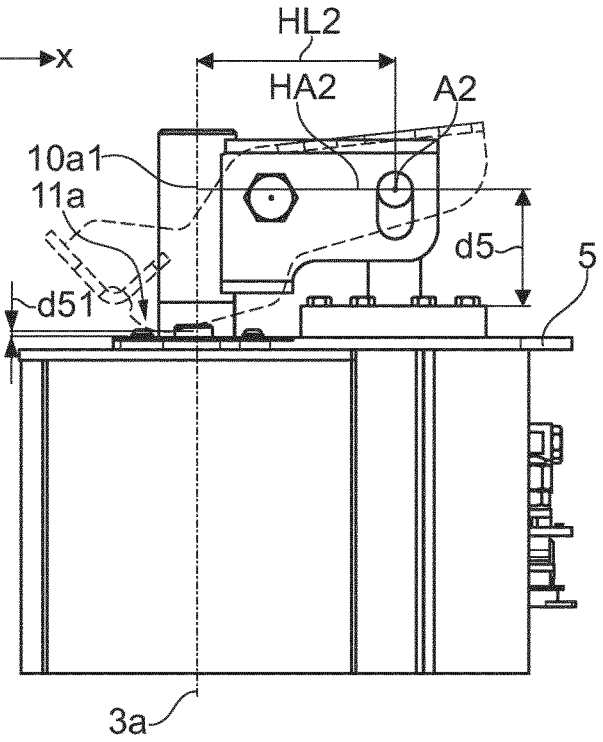
Fig. 7f
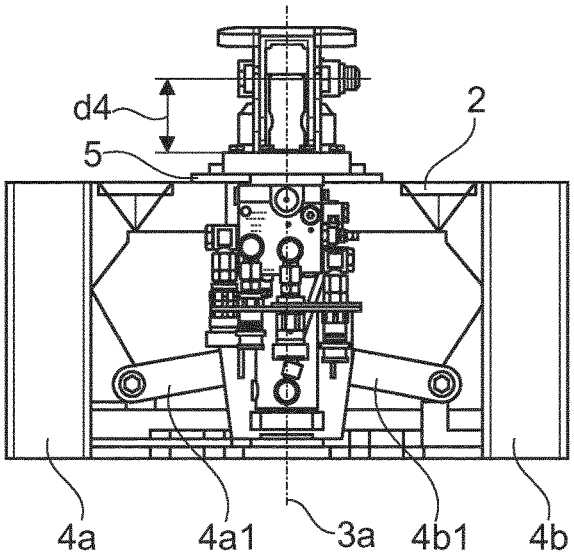
Fig. 7e'
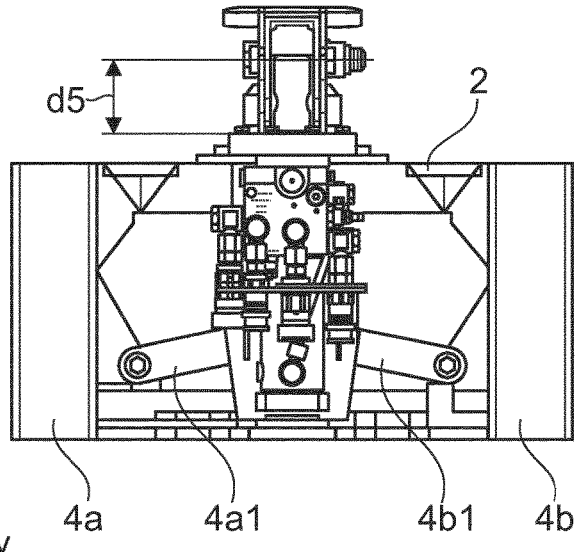
Fig. 7f'
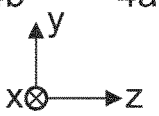

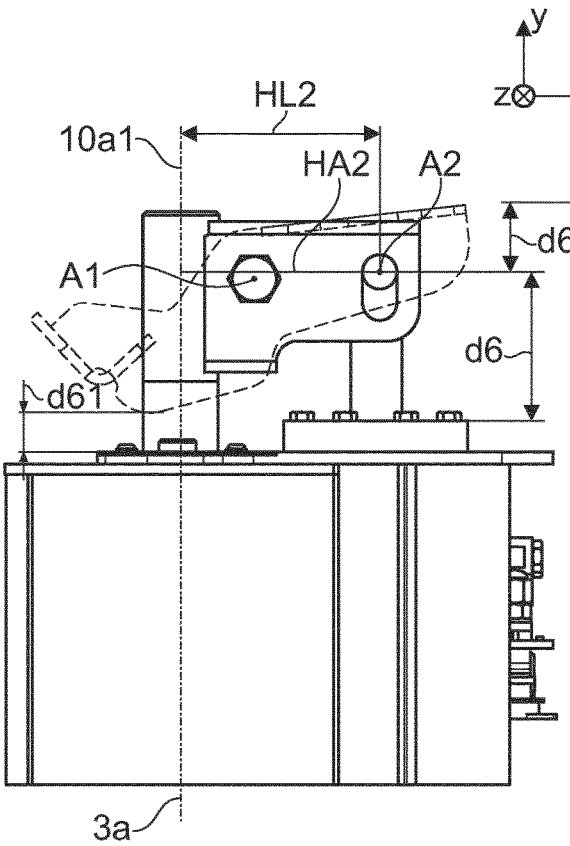
Fig. 7g
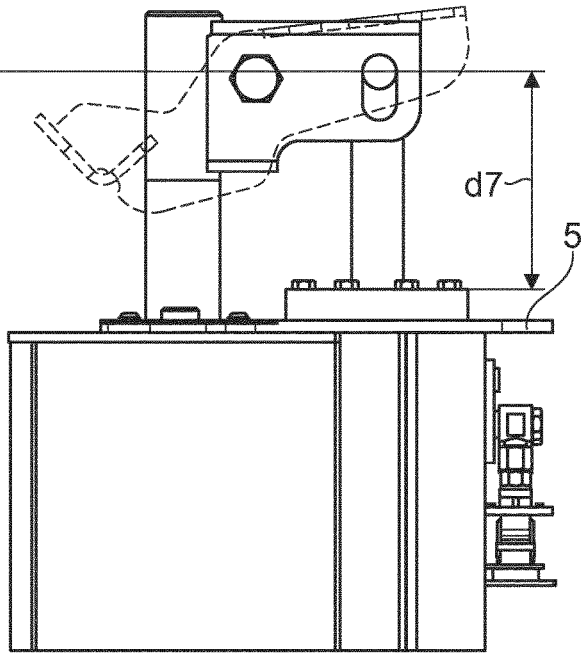
Fig. 7h
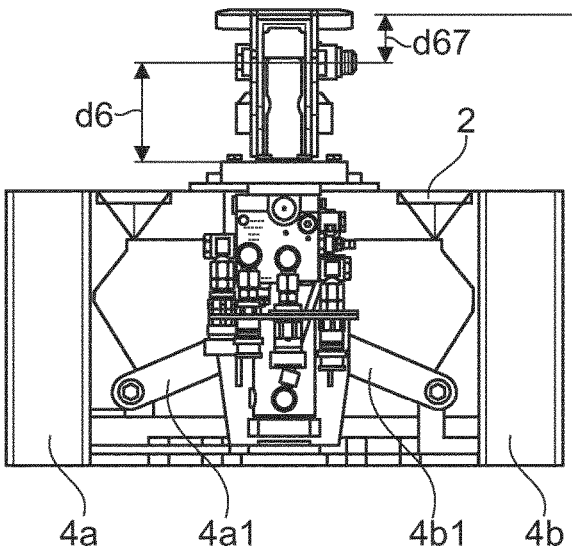
Fig. 7g'
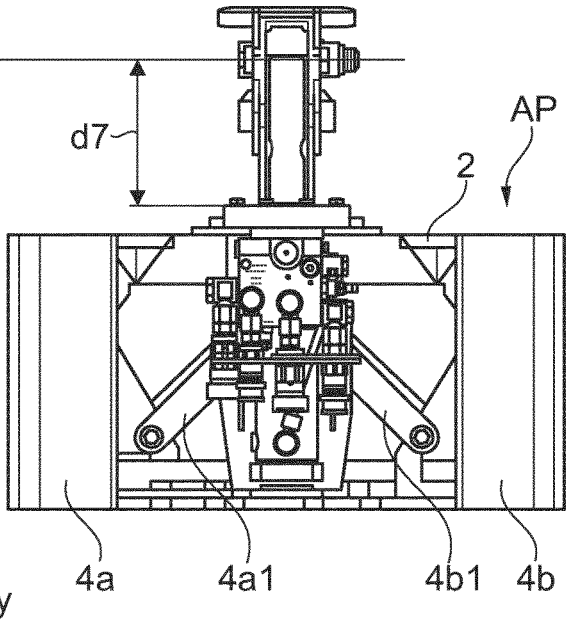
Fig. 7h'
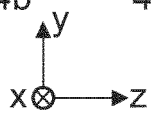

UNBOARDING DEVICE FOR A FORMWORK ELEMENT

FIELD

The invention relates to an unboarding device for a formwork element, which includes a base element and a tension/compression rod to extend or retract at least one further formwork element coupled laterally with the base element into or out of a boarding or unboarding position through a linear movement of the tension/compression rod essentially parallel to its rod axis relative to the base element. Additionally, the invention concerns a method for unboarding the formwork element and a method for boarding the corner formwork element.

BACKGROUND

At the corners of a shaft formwork, each corner formwork element can be arranged, which includes a corner base element and a tension rod to move further formwork elements coupled on both sides to the corner base element upward along its essentially vertically standing tension rod axis relative to the corner base element into an unboarding position. Similarly, at walls or ceilings of a wall or ceiling formwork, at least one formwork element can be arranged, which includes a base element and a tension rod to move at least one formwork element coupled on one side with the base element upward essentially parallel to its vertically standing rod axis relative to the base element into an unboarding position. Upon completion of the hardening of the concrete introduced into the formwork, there are several ways to detach/unboard the formwork from the hardened concrete. For instance, a manually operated lever tool can be placed on a corner of the shaft formwork to lift the tension rod relative to the corner base element. Alternatively, the movement of the tension rod for unboarding can be supported by a crane. It is also known to pull the tension rod using a hydraulic hollow piston cylinder placed on the corner of the shaft formwork, where the manually operated lever tool must first be dismantled. The use of a hydraulic hollow piston cylinder placed on the shaft/wall or ceiling formwork is costly and, in the case of a shaft formwork, requires significant construction space above the shaft formwork level, which is particularly disadvantageous for suspended shaft formwork. An alternative to an attached hollow piston cylinder is the use of a reinforced special shaft corner in combination with one or more hydraulic units, which leads to increased effort in planning and/or storage compared to using a standard formwork portfolio. Furthermore, there is a limited range of applications regarding the type of formwork used or the available possibly mobile hydraulics on the construction site. Moreover, planned manual emergency operation of the shaft corners in case of hydraulic failure is usually not provided, and often no safety measures are in place to prevent uncontrolled formwork movements in the event of incorrectly connected and/or damaged hydraulic lines. The risk of uncontrolled formwork movements always poses a safety hazard for the worker responsible for the unboarding, whose safety is of utmost priority on the construction site.

SUMMARY

Object of the present invention is thus to provide an unboarding device mountable on a formwork element from a standard formwork portfolio, enabling the necessary unboarding forces to be introduced into the formwork element without damaging it. In particular, the unboarding device should be compact and easily mountable on the formwork element without requiring the modification of the formwork element into a special formwork element. The invention aims to avoid or at least reduce the disadvantages of the prior art during the unboarding of formworks, thereby reducing the effort required for unboarding and increasing work safety.

This objective is achieved with an unboarding device, a method for unboarding a formwork element, and a method for boarding a formwork element. The subclaims specify advantageous further developments.

The objective of the invention is thus achieved by an unboarding device for a formwork element comprising a base element, a tension/compression rod, and at least one boarding/unboarding element to extend or retract at least one boarding/unboarding element coupled laterally with the base element through a linear movement of the tension/compression rod essentially parallel to its rod axis relative to the base element into a boarding or unboarding position. The unboarding device includes a first unboarding element comprising a contact element and a cylinder section of a lifting device rigidly arranged to the contact element, where the lifting device can be driven by a drive unit. The contact element is designed so that a piston end section of the lifting device can move away from the base element when the cylinder section supports itself on the base element through the contact element. Furthermore, the unboarding device includes a second unboarding element comprising an arm that can be reversibly attached to an end section of the tension/compression rod and, when attached, extends from the rod, and a tilting element rotatably coupled to the arm around a tilting axis. The tilting element can be rotatably coupled to the piston end section of the lifting device around a joint axis and is designed to support itself on the base element when the piston end section moves away from the formwork element. When the arm is attached to the end section of the rod, a first lever arm perpendicular to the rod axis and the tilting axis extends between the rod axis and the tilting axis with a first lever arm length that is smaller than a second lever arm length of a second lever arm extending between the rod axis and the joint axis perpendicular to the rod axis and the joint axis.

In the boarded state of the formwork element, i.e., in the boarding and/or unboarding state, the rod axis can be arranged essentially vertically, whereby a linear movement of the tension rod relative to the base element upwards leads to the at least one boarding/unboarding element being retracted into the unboarding position. A linear movement of the tension rod relative to the base element downwards can lead to the at least one boarding/unboarding element being extended into the boarding position. The state of the boarding/unboarding element extended into the boarding position will be referred to as the boarded state of the formwork element, and the state of the boarding/unboarding element retracted into the unboarding position will be referred to as the unboarded state of the formwork element. The drive unit can be arranged externally to the unboarding device and/or the formwork element and can be, for example, a hydraulic unit, a pneumatic unit, or, if the lifting device includes a spindle lift gear, an electric motor.

By means of the coupling of the tilting element to the arm in such a way that, when the arm is attached to the end section of the rod, the first lever arm, which extends between the rod axis and the tilting axis, is shorter than the second lever arm, which extends between the rod axis and the joint axis, there is a lever arm adjustment from the technically possible second to the first lever arm acting on the arm when the piston end section of the lifting device moves away from the base element. The highest pressure in the lifting device and thus the highest unboarding force during the unboarding process will build up at the beginning of the unboarding process when breaking the formwork away from the hardened concrete wall/ceiling/shaft corner, and decrease after the breaking process is completed. This force required for breaking away is not introduced into the tension/compression rod through the arm attached to the piston end section of the lifting device, but through the tilting element, which can support itself on the base element of the formwork element, particularly directly on a tension/compression rod holder of the formwork element. Therefore, a reduced bending moment of the first lever arm acts on the tension/compression rod during the initial lifting movement. Consequently, increased forces can be introduced into the unboarding mechanism of the formwork element/corner formwork element to break the formwork away from the hardened concrete without damaging the formwork element/corner formwork element or the unboarding device, for example, through permanent deformations.

After a completed tilting movement of the tilting element, the unboarding device allows, with the arm attached to the piston end section of the lifting device and a continued lifting movement in the same direction that led to the tilting movement of the tilting element, that with an increased lever arm caused by the arm without the tilting element compared to the first lever arm caused by the tilting element on the arm, the arm without the tilting element with the increased lever arm takes over the force introduction into the tension/compression rod from the arm with the tilting element. The tilting movement of the tilting element can be ended, for example, by a stop of the tilting element that rests against the arm at a predetermined tilting angle. Due to the lower resistance prevailing after the breaking away of the boarding/unboarding element from the concrete wall, as the boarding/unboarding element adhering to the concrete is already detached from the concrete wall and only a movement of its own weight of the boarding/unboarding element needs to be initiated, a lower lifting force compared to the breaking away is built up to move the boarding/unboarding element into the unboarding position. This prevents overloading the lifting device of the first unboarding element and the arm and the tilting element of the second unboarding element, and thus the unboarding device as a whole. Through the extended lever arm compared to the first lever arm for breaking away the boarding/unboarding element from the concrete, and the lifting device, and the outer section of the base element of the formwork element resting on the contact element of the first unboarding element, the force for moving the tension/compression rod can be efficiently and gently introduced into the base element, ensuring that no permanent deformations occur on the base element and the unboarding device due to the boarding and/or unboarding of the formwork element.

The introduction of the lifting force of the lifting device of the first unboarding element through the first lever arm—being shorter than the second one—of the second unboarding element into the tension/compression rod to move the tension/compression rod into the unboarding position of the boarding/unboarding element, combined with the design of the tilting element such that it can support itself directly or indirectly on the base element when the cylinder section of the lifting device moves away from the base element, allows for a force introduction into the tension/compression rod that is gentle on the lifting device and the base element, so that the necessary unboarding forces can be introduced without damaging the formwork element/corner formwork element. The lifting device of the first unboarding element can be driven by a drive unit integrated into the lifting device or arranged externally to the first unboarding element. The drive unit can be in the form of a hydraulic unit available on a construction site. The gentle and efficient introduction of the lifting force into the tension/compression rod with the shortened first lever arm allows for the use of an externally available drive unit on the construction site. The contact element of the first unboarding element is designed so that the piston end section of the lifting device can move away from the base element when the cylinder section of the lifting device supports itself on the base element through the contact element. The contact element thus ensures a gentle and sufficient application of the lifting force to the tension/compression rod. Since the arm can also be attached to the end section of the tension/compression rod, the unboarding device can be retrofitted to the formwork element/corner formwork element.

The contact element and the lifting device can be separate or integrated parts. The arm, for example, made of steel or aluminium, can be solid and composed of one or more parts, although it is also possible to design it as a hollow body. Without the drive unit, the unboarding device can be compact and easily and with little manual effort mountable on the formwork element/corner formwork element. The first and second unboarding elements can be integrated or separately coupled. In the following, the base element of formworks will also be used synonymously for a corner base element of a corner formwork element, and vice versa, where boarding/unboarding elements coupled on both sides with the corner base element can be extended or retracted into a boarding or unboarding position through a linear movement of the tension/compression rod whose rod axis is essentially vertically arranged in the boarded state of the corner formwork element.

The arm can include a rod element reversibly attachable to the end section of the rod, whose rod axis runs essentially coaxial or parallel to the rod axis and includes an arm element extending from the rod element and rigidly connected to the rod element, to which the tilting element is rotatably coupled around the tilting axis. The length of the rod element can be chosen so that when the arm is attached to the end section, the arm element and the tilting element are arranged outside the base element. If the end section of the rod is arranged within the base element, the rod element allows the tension/compression rod to be "extended" to the outside of the base element to rigidly connect the arm element extending from the rod element to the rod element. The length of the rod element can be chosen so that the arm element is connected perpendicularly to the rod element. The rod element can be designed as a cylindrical hollow body, for example, made of steel or aluminium. The arm element can be solid and composed of one or more parts, for example, made of steel or aluminium, although it is also possible to design it as a hollow body, for example, made of steel or aluminium. The rigid connection between the rod element and the arm element can be detachable, for example, by means of a screw connection or fixed, for example, by means of a weld seam.

In an advantageous embodiment of the unboarding device, when the tilting element is rotatably coupled to the piston end section of the lifting device around the joint axis, a lifting axis of the lifting device can run essentially parallel to the rod axis and the lifting device can be spaced from the rod element essentially by the length of the second lever arm, so that the first unboarding element and the second unboarding element form a U-shape. This embodiment allows for a particularly compact form of the unboarding device, where the contact element can rest on an outer surface of the base element outside the base element, and the rod element and the lifting device are arranged below the outer surface of the base element. In the attached state of the unboarding device to the end section of the rod, the height extending beyond the outer surface of the base element in this case is determined by the height of the tilting element and/or the arm outside the base element. The height extending beyond the base element can be approximately 144 mm in the fully retracted state of the lifting device and approximately 250 mm in the fully extended state of the lifting device. The first unboarding element can be designed so that when the second unboarding element is attached to the end section of the rod, a contact element end section of the contact element arranged below the outer surface of the base element supports itself on a rigid sheet element of the base element between frame legs, through which the at least one boarding/unboarding element is coupled to the tension/compression rod to cause an introduction of support moments into the rigid sheet element. This ensures a stable application of the first unboarding element to the base element (cantilever effect), especially when the rigid sheet element is welded to an outer wall and/or the frame legs of the base element.

A compact form results from the lifting axis of the lifting device running essentially parallel to the rod axis and the lifting device being spaced from the rod element essentially by the length of the second lever arm, so that the first and second unboarding elements form a U-shape. In this case, when the rod element is attached to the end section of the rod, the height of the unboarding device outside the base element is essentially determined by the height of the tilting element.

An advantageous embodiment is given when, in a state where the arm is attached to the end section of the rod, the tilting element has a support section to support itself on the base element in a first section of the tilting element, which, with respect to a plane with the rod axis and a normal vector perpendicular to the tilting axis, opposes a second section of the tilting element in which the tilting element is rotatably coupled to the arm. The support section can provide support for the first lever arm during a lifting movement to unboard the formwork element without impairing the effect of the first lever arm when introducing the lifting force into the tension/compression rod. Horizontal fixation of the tilting element can be achieved, leading to stable movement of the tilting element and thus the tension/compression rod.

A rim of the support section of the tilting element facing the rod element can border the outer side of the rod element facing the rim without contact at a distance such that the outer side of the rod element can move past the rim of the support section without friction. This way, the first lever arm can be used to introduce the lifting force into the tension/compression rod without extension due to an avoidable distance of the support section from the rod axis. Through the vertical force introduction directly to a welded sleeve of the tension rod guide of the frame profile of the base element for guiding the tension/compression rod, a central tubular profile stiffness can be used to avoid permanent deformations of the base element. Additionally, horizontal force introduction can occur into pressed flange sleeves of a frame profile of the base element. The pressed flange sleeves represent a local material doubling and are thus better suited for introducing horizontal forces without permanent deformations than areas of the base element with single wall thickness.

A particularly advantageous embodiment is given when the first unboarding element includes a wear layer element, which can be designed as a horseshoe-shaped plate arranged between the contact element and the first section of the tilting element in the area of the support section when the tilting element is rotatably coupled to the piston end section of the lifting device around the joint axis. The support force of the support section of the tilting element can then be introduced into the wear layer element of the first unboarding element instead of an outer surface of the base element, avoiding or at least reducing permanent deformations of the base element compared to an embodiment of the unboarding element without a wear layer element.

When the arm is attached to the end section of the rod, the arm advantageously has an extending section from the tension/compression rod, particularly an extending section from the tension/compression rod at an arm end section such that a third lever arm extending perpendicular to the rod axis between the rod axis and the piston end section of the lifting device has a third lever arm length greater than the first lever arm length of the first lever arm, and during a continued lifting movement of the lifting device in one direction, a force is introduced into the tension/compression rod essentially parallel to the rod axis for unboarding first by the tilting element using the first lever arm and subsequently by the arm using the third lever arm. This way, the lifting force can be introduced into the tension/compression rod in a manner that is gentle and effective on the base element and the unboarding device, and permanent deformations of the base element and/or the unboarding element can be avoided. A simple design results for the third lever arm when the arm in the extending section from the tension/compression rod has a slot oriented in the direction of the lifting movement and a pin element, particularly a bolt, coupled to the piston end section of the lifting device is guided through the slot and rotatably coupled to the tilting element around the joint axis.

The tilting element can advantageously have the shape of a clamp with two legs, particularly connected at both ends, in which the arm is arranged, with the tilting axis formed by a rod element, particularly a bolt, extending through the two legs and the arm. This results in a flat design with low height and material effort while providing sufficient stiffness to introduce the forces required to unboard the formwork element.

An advantageous embodiment is given when the lifting device is designed to be driven by the drive unit in the form of a hydraulic unit, a pneumatic unit, a spindle lift gear with a rotating motor, particularly an electric motor, or manually by means of a crank or ratchet, or by a combination thereof. Hydraulic units are often already available on a construction site for use in climbing systems. When the drive unit is arranged externally to the lifting device, the unboarding device can be compact and lightweight, so that it can be manually mounted on the base element. This simplifies the mounting of the unboarding device compared to an embodiment with an integrated drive unit and increases work safety.

To ensure high work safety, the unboarding device can include a valve device interposed between the hydraulic unit and the lifting device, comprising either cylinder- and piston-side load-holding valves and a piston- or cylinder-side pressure relief valve, or cylinder- and piston-side check valves and a piston- or cylinder-side pressure relief valve. The load-holding valves ensure that during both the unboarding movement to detach the formwork element from the concrete wall and the boarding movement to precisely set the formwork according to the plan, the hydraulic cylinder of the lifting device remains in its respective lift position independent of external events, such as a stop of the hydraulic unit, a pressure loss in a hydraulic line, or an external load impact, providing a safety function without uncontrolled movement of the formwork. The pressure relief valve provides an overload protection function such that if the applied oil pressure exceeds the allowable operating level, for example, 190 bar, the excess pressure is automatically diverted from an inlet line to a return line without damaging connected components or the lifting device and/or the hydraulic unit itself.

A simple application of the unboarding device together with other unboarding devices is given when the valve device is connected to the hydraulic unit via a first pair of couplings for the inlet lines and a second pair of couplings for the return lines, particularly with T-pieces integrated into the valve device and/or the inlet and return lines. Four visible connections can be present, with two forming an inlet coupling pair and the other two forming a return coupling pair. Instead of specially configured hydraulic ring lines with branches, the unboarding devices can thus be connected and disconnected with simple standard hoses, for example, via quick connectors, enhancing work efficiency on the construction site. Additionally, with multiple valve devices interconnected via inlet and return lines with inlet and return coupling pairs, an optimized uncontrolled oil supply in the form of a ring supply line can occur, where the principle of least resistance applies. The oil volume is free to build pressure in the cylinder with the lowest resistance first until the maximum oil pressure is available for the formwork elements with higher adhesion. This ensures an optimized uncontrolled oil supply to all valve devices and lifting devices.

The tilting element can include a crane eye in another advantageous embodiment. The crane eye can be particularly advantageous when the arm is attached to the end section of the rod in a first section of the tilting element, which, with respect to a plane with the rod axis and a normal vector perpendicular to the tilting axis, opposes a second section of the tilting element in which the tilting element is rotatably coupled to the arm. By pulling a crane or another lifting device upwards at multiple crane eyes, multiple formwork elements/corner formwork elements can be lifted and removed from the area of the hardened concrete using multiple unboarding devices. If the lifting device of the unboarding device or the drive unit is defective, an unboarding can be performed using the second unboarding element by a lifting movement of a crane with its crane hook coupled to the crane eye, particularly when the first unboarding element is decoupled from the second unboarding element.

The first unboarding element can include at least one handle designed as a slot with an orientation perpendicular to the rod axis and/or at least one further handle designed as a slot with an orientation parallel to the rod axis for simple and safe manual mounting or dismounting from the second unboarding element and/or the base element.

The invention also includes a formwork arrangement comprising the unboarding device according to the invention, the base element, and the formwork element.

The invention also includes a method for unboarding a formwork element, particularly a corner formwork element, for boarding and unboarding inner corners, particularly of shafts, where the formwork element comprises a base element, a tension/compression rod, and at least one boarding/unboarding element to extend or retract the at least one boarding/unboarding element coupled laterally with the base element through a linear movement of the tension/compression rod essentially parallel to its rod axis relative to the base element into a boarding or unboarding position. The method includes the following steps:

a) Providing a formwork element and an unboarding device according to the invention
b) Reversibly attaching the arm of the second unboarding element of the unboarding device to the end section of the tension/compression rod
c) Coupling the tilting element of the second unboarding element of the unboarding device to the piston end section of the lifting device of the first unboarding element of the unboarding device such that the tilting element is rotatable relative to the arm around the joint axis
d) Connecting a drive unit, particularly in the form of a hydraulic unit, pneumatic unit, or, if the lifting device includes a spindle lift gear, an electric motor, to the lifting device of the unboarding device if the drive unit is not integrated into the lifting device
e) Activating the drive unit such that a lifting movement of the piston end section of the lifting device in a direction away from the base element, particularly a direction essentially parallel to the rod axis upwards, introduces a force into the tension/compression rod essentially parallel to the rod axis to unboard the formwork element from the tilting element using the first lever arm, and
f) Performing the linear movement of the tension/compression rod relative to the base element to retract the at least one boarding/unboarding element coupled laterally with the base element into the unboarding position.

A gentle and efficient force introduction into the tension/compression rod for the base element and/or the unboarding device results when the method for unboarding a formwork element additionally includes the steps:

a1) Providing the arm in an extending section from the tension/compression rod with a slot oriented in the direction of the lifting movement
a2) Guiding a pin element, particularly a bolt, coupled to the piston end section of the lifting device through the slot
a3) Coupling the pin element to the tilting element such that the pin element is rotatable around the joint axis of the tilting element, and the step f) additionally includes the steps:

f1) Performing a continued lifting movement of the lifting device in one direction
f2) Introducing a force into the tension/compression rod essentially parallel to the rod axis for unboarding first by the tilting element using the first lever arm, and
f3) Subsequently introducing a further force into the tension/compression rod essentially parallel to the rod axis for unboarding by the arm using the second lever arm extending perpendicular to the rod axis between the rod axis and the pin element.

Another method of the invention serves to board a formwork element, particularly a corner formwork element, for boarding and unboarding inner corners, particularly of shafts, where the formwork element comprises a base element, a tension/compression rod, and at least one boarding/unboarding element to extend or retract the at least one boarding/unboarding element coupled laterally with the base element through a linear movement of the tension/compression rod essentially parallel to its rod axis relative to the base element into a boarding or unboarding position. The method includes the steps:

a) Performing the steps a) to d) according to the previously described method for unboarding a formwork element e) Activating the drive unit such that a lifting movement of the lifting device in a direction towards the base element, particularly a direction essentially parallel to the rod axis downwards, introduces a force into the tension/compression rod essentially parallel to the rod axis to board the formwork element from the tilting element using the second lever arm, and f) Performing the linear movement of the tension/compression rod relative to the base element to extend the at least one boarding/unboarding element coupled laterally with the base element into the unboarding position.

The above-described methods of the invention have the corresponding advantages and effects of the above-described unboarding devices of the invention.

Further features and advantages of the invention result from the following detailed description of an embodiment of the invention from the claims and based on the figures showing essential details of the invention. The features shown in the figures are represented in such a way that the specific features of the invention can be made clearly visible. The various features can be implemented individually or in combination in any variations of the invention. In the figures, identical reference signs denote identical or corresponding elements.

BRIEF DESCRIPTION OF THE DRAWINGS

In the Figures,

FIGS. 7*a-h* show side views of the unboarding device mounted on the corner formwork element with a dashed tilting element to a side view of the arm of the second unboarding element in a movement sequence of the lifting device for unboarding the corner formwork element.

FIGS. 7*a'*-h' show front views of the unboarding device mounted on the corner formwork element corresponding to the side views shown in FIG. 7*a-h* in the movement sequence of the lifting device for unboarding the corner formwork element with exterior views of joint levers coupled to the tension/compression rod in different positions relative to the tension/compression rod.

FIGS. 8*a'-c'* show front views of the unboarding device mounted on the corner formwork element corresponding to the side views shown in FIG. 8*a-c* in the movement sequence of the lifting device for boarding the corner formwork element with exterior views of joint levers in different positions relative to the tension/compression rod.

DETAILED DESCRIPTION

Figure 1A:
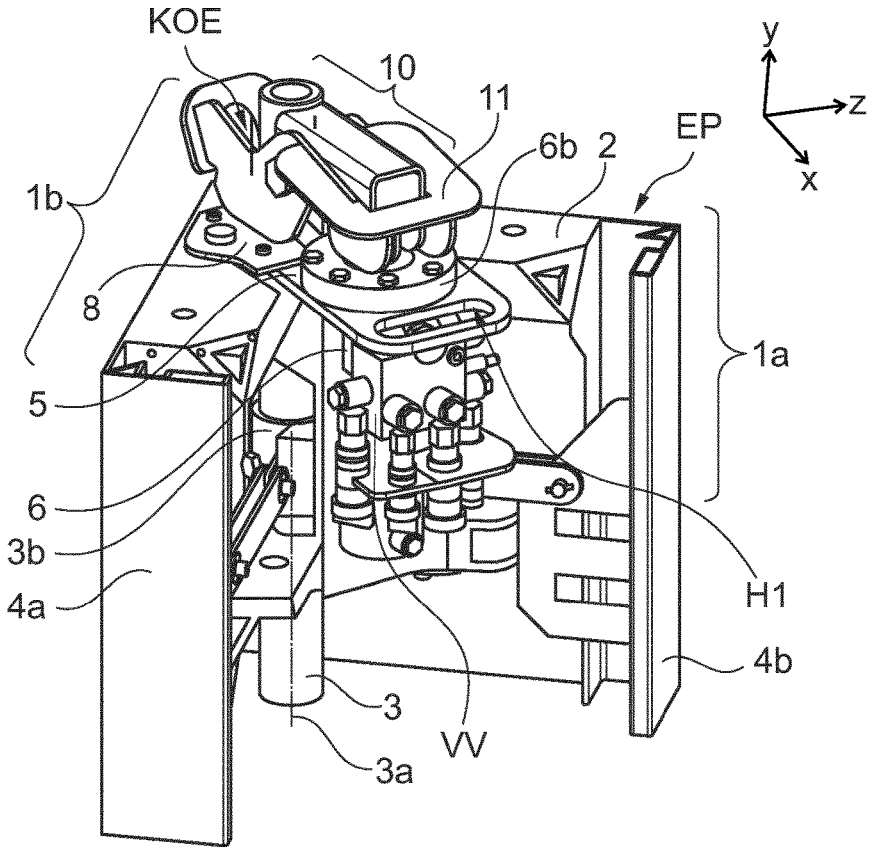
FIGS. 1*a-c* show a spatial exterior view (a) of the unboarding device according to the invention mounted on a corner base element of a corner formwork element with boarding/unboarding elements in a boarding position, a side view (b) of this unboarding device combined with a cross-sectional view of a tension/compression rod of the corner formwork element and a rod element of an arm of the unboarding device, and a spatial side and rear view (c) of this unboarding device combined with a cross-sectional view of the corner base element.

In FIG. 1*a*, a spatial exterior view of the unboarding device 1 according to the invention is shown mounted on a corner base element 2 with boarding/unboarding elements 4*a* 4*b* in a boarding position BP of the boarding/unboarding elements 4*a* 4*b* relative to the corner base element 2. The unboarding device 1 includes a first unboarding element 1*a* and a second unboarding element 1*b*, where the first unboarding element 1*a* includes a contact element 5 and a lifting device 6, and the second unboarding element 1*b* includes an arm 10 and a tilting element 11 rotatably coupled to the arm 10. A cylinder section 6*b* of the lifting device 6 is rigidly arranged to the contact element 5, where the cylinder section 6*b* can include the contact element 5. In FIG. 1*a*, the cylinder section 6*b* is designed as a separate element from the contact element 5. Between a support section of the tilting element 11 and a surface of the contact element 5, a wear layer element 8 is arranged to prevent the support section of the tilting element 11 from resting directly on a surface of the corner base element 2 with a normal vector in the Y direction at the beginning of an unboarding operation of the unboarding device 1, when piston end portion in the moves in the Y direction, thereby avoiding permanent deformations of the surface of the corner base element 2. The arm 10 includes a cylindrical rod element attached to an end section 3*b* of a tension/compression rod 3, where the rod axis of the rod element of the arm 10 is parallel to the rod axis 3*a* of the tension/compression rod 3. The corner formwork element includes the tension/compression rod 3, which is coupled to the boarding/unboarding elements 4*a* 4*b* through joint levers, such that a movement of the tension/compression rod 3 in the Y direction relative to the corner base element 2 retracts the boarding/unboarding elements 4*a* 4*b* from the boarding position BP into an unboarding position AP relative to the corner base element 2. The tension/compression rod 3 can be pushed from below the corner formwork element for unboarding using the unboarding device 1, rather than being pulled from above as in the present embodiment. Similarly, the tension/compression rod 3 can be pulled downwards from below the corner formwork element for boarding using the unboarding device 1, rather than being pushed downwards from above as in the present embodiment.

The tilting element 11 includes a crane eye KOE arranged as a recess at an end section of the tilting element 11 in the negative X direction. The first unboarding element 1*a* includes a handle H1 in the form of a slot oriented in the Z direction for manually coupling the first unboarding element 1*a* to the second unboarding element 1*b*. A valve device VV is connected to the lifting device 6 of the first unboarding element 1*a*, through which the lifting device 6 can be connected to a hydraulic unit.

Figure 1B:
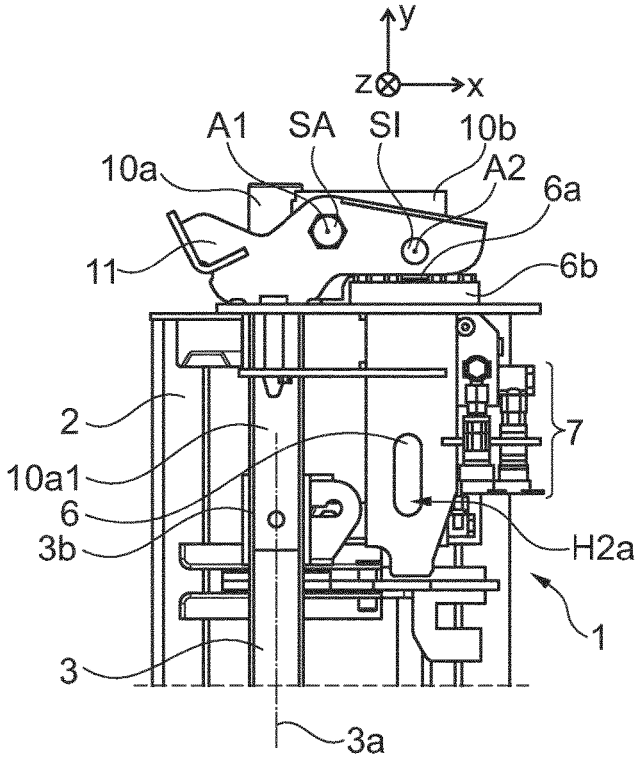

In FIG. 1*b*, the unboarding device 1 shown in FIG. 1*a* is depicted in a side view combined with a cross-sectional view of the tension/compression rod 3 of the corner formwork element and the rod element 10*a* of the arm 10. When the rod element 10*a* is attached to the end section 3*b*, the rod axis 10*a*1 runs parallel to the rod axis 3*a* of the tension/compression rod 3. The contact element 5 rests on an outer surface of the corner base element 2 and is designed so that a piston end section 6*a* of the lifting device 6 can move away from the corner base element 2 when the cylinder section 6*b* supports itself on the corner base element 2 through the contact element 5. A rod element 10*a* extends in the X direction from the cylindrical rod element, with the tilting element 11 rotatably coupled to the arm 10 around a tilting axis A1 by means of a bar element SA. The tilting axis A1, formed by the bar element SA, runs in the Z direction, like a joint axis A2, formed by a pin element SI, through which the tilting element 11 is coupled to a piston end section 6*a* of the lifting device 6. In a state where the arm 10 is attached to the end section 3*b*, a first lever arm HA1 perpendicular to the rod axis 3*a*, oriented in the Y direction, and the tilting axis A1, oriented in the Z direction, extends between the rod axis 3*a* and the tilting axis A1 with a first lever arm length HL1 that is smaller than a second lever arm length HL2 of a second lever arm HA2 extending between the rod axis 3*a* and the joint axis A2, perpendicular to the rod axis 3*a* and the joint axis A2. The first unboarding element 1*a* includes another handle H2*a* with a slot oriented in the Y direction. The valve device VV is connected to a connection unit 7 in such a way that inlet/outlet lines can be connected to the connection unit 7 to supply the lifting device 6 with oil or oil pressure via the valve device VV.

Figure 1C:
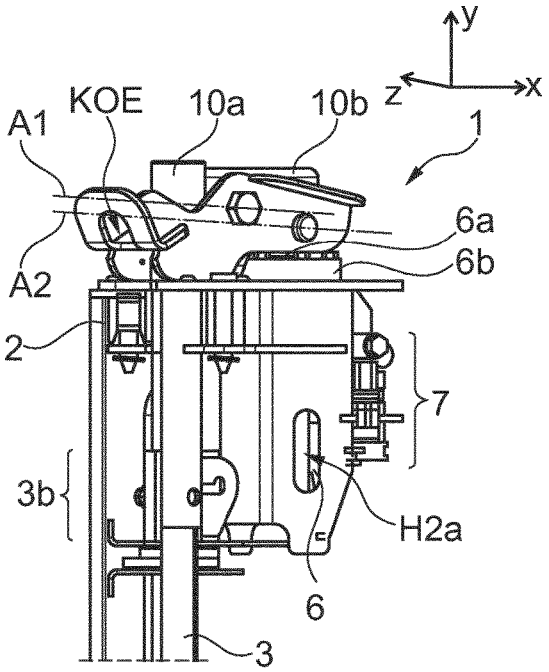

In FIG. 1*c*, a spatial side and rear view of the unboarding device 1 combined with a cross-sectional view of the corner base element 2 of the corner formwork element with the corner base element 2, the tension/compression rod 3, and the boarding/unboarding elements 4*a* 4*b* is shown. Besides the handle H2*a* shown in FIG. 1*b*, there is a second handle H2*b* designed as a slot oriented in the Y direction (not shown), parallel to the handle H2*a* in the Z direction and arranged symmetrically to an x/y plane to the handle H2*a*. The tilting axis A1, through which the tilting element 11 is rotatably coupled to the arm 10, runs parallel to the joint axis A2, through which the tilting element 11 is rotatably connected to the piston end section 6*a*. In the fully retracted state of the lifting device 6, the unboarding device 1 has a height above the corner base element 2 in the Y direction, determined by the height of the rod element 10*a*. In other embodiments, the height of the unboarding device 1 is essentially determined by the height of the tilting element 11. A lifting axis of the lifting device 6 runs essentially parallel to the rod axis 10*a*1 and is spaced from the rod axis 10*a*1 of the rod element 10*a* in the X direction essentially by the length of the arm element 10*b*. In the mounted state of the unboarding device 1 on the corner formwork element in the boarded state, a compact form of the unboarding device 1 results, ensuring low construction space requirements on the construction site and reducing the risk of a tripping hazard for a worker on the construction site. In the mounted state of the unboarding device 1 on the corner formwork element with the corner base element 2, flange sleeves are arranged below the wear layer element 8 in a frame profile of the corner base element 2, enhancing the stability of the corner base element 2 in the area subjected to high mechanical stress during a lifting movement in the Y direction due to the support of the support section of the tilting element 11 through the wear layer element 8 on the corner base element 2. The valve device VV and the connection unit 7 are connected to the lifting device 6 oriented in the Y direction in the form of a "valve backpack" with an orientation in the Y direction. The orientation of the valve device VV and the connection unit 7 in the Y direction, in which the lifting device 6 is oriented, results in a compact form of the first unboarding element 1*a*, allowing for simple mounting of the first unboarding element 1*a* to the already mounted second unboarding element 1*b*.

Figure 2A:
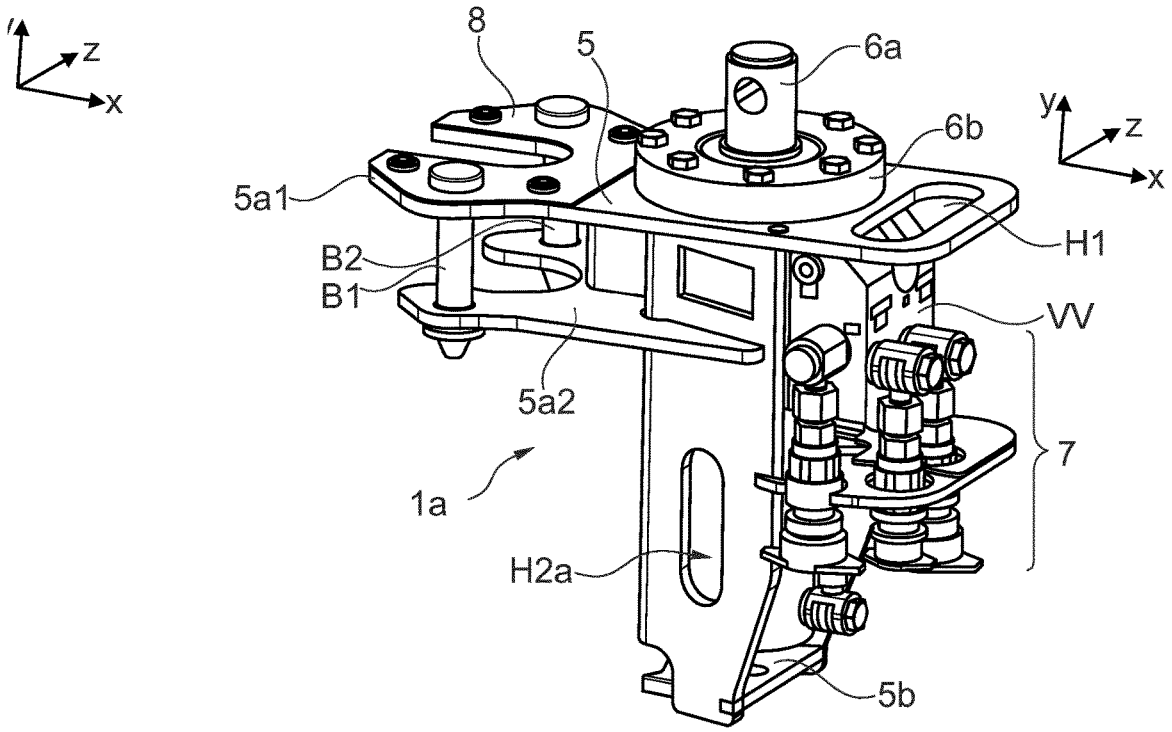
FIG. 2*a, b* show spatial exterior views of a first unboarding element (a) and a second unboarding element (b) of the unboarding device according to the invention.
Figure 2B:
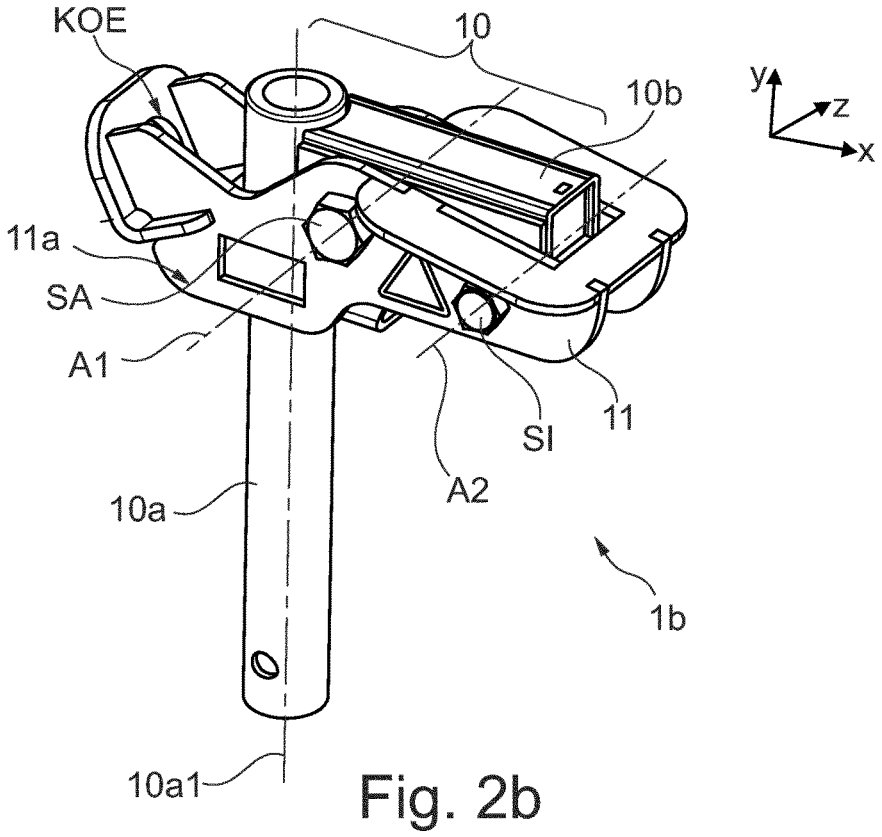

In FIGS. 2*a* and 2*b*, spatial exterior views of the first unboarding element 1*a* and the second unboarding element 1*b* of the unboarding device 1 are shown. In FIG. 2*a*, the handle H1 oriented in the Z direction is arranged perpendicular to the other handle H2*a* oriented in the Y direction on the first unboarding element 1*a*. The contact element 5 includes the wear layer element 8 in a horseshoe shape arranged on an upper contact element section 5*a*1 of the contact element 5, while a lower contact element section 5*a*2 of the contact element 5 is arranged parallel and in the Y direction offset to the wear layer element 8 and the upper contact element section 5*a*1. The lower contact element section 5*a*2, like the wear layer element 8 and the upper contact element section 5*a*1, has a horseshoe shape with an opening in the negative X direction, allowing the first unboarding element 1*a* to be mounted on the corner base element 2 such that a vertical force introduction in the negative Y direction can occur directly at a welded sleeve of a tension/compression rod guide of the frame profile of the corner base element 2. The first unboarding element 1*a* is mounted via two screw connections through bolts B1 B2 inserted in the negative Y direction, which can be secured with retaining rings/pins to attach the first unboarding element 1*a* to the corner formwork element. A central tubular profile stiffness relative to the tension/compression rod 3 can thus be used for stable mounting of the first unboarding element 1*a* on the corner base element 2. The contact element 5, in addition to the upper and lower contact element sections 5*a*1 5*a*2, includes a contact element end section 5*b* that allows for support moment introduction into welded rigid sheet elements between frame legs arranged on the corner base element 2 to couple the boarding/unboarding elements 4*a* 4*b* to the corner base element 2. The support of the contact element end section 5*b* on the rigid sheet element between the frame legs of the corner formwork element can create support in the negative X direction using a cantilever effect (see also arrangement of the first unboarding element 1*a* on the corner formwork element as shown in FIGS. 1*b* and 1*c*). Due to the alignment of the contact element 5 in the X direction with a contact surface in the x/z plane and the alignment of the lifting device 6 with the valve device VV and the connection element 7 perpendicular to the contact element 5 in the negative Y direction, a design for the first unboarding element 1*a* results, allowing for mounting on an upper frame profile of the corner base element 2 essentially parallel to the tension/compression rod 3. This results in a low height of the unboarding device 1 above the corner base element 2, determined essentially by the height of the tilting element 11, which can be 144 mm in the fully retracted state of the lifting device 6 and 250 mm in the fully extended state of the lifting device 6. Additionally, the compact design allows for easy accessibility of the corner formwork element for mounting the first unboarding element 1*a* for possible retrofitting of the unboarding device 1 on an existing corner formwork element.

In FIG. 2*b*, a spatial exterior view of the second unboarding element 1*b* is shown, with the bar element SA acting as the tilting axis A1 and the pin element SI acting as the joint axis A2.

The tilting element 11 is rotatably coupled to the arm element 10*b* of the arm 10 around the tilting axis A1 and to the piston end section 6*a* of the lifting device 6 of the first unboarding element 1*a* around the joint axis A2. The rod element 10*a* of the arm 10 is designed as a hollow cylindrical body with the rod axis 10*a*1. The tilting element 11 includes a support section 11*a* for supporting on the corner base element 2, shown in FIGS. 1*a* to 1*c*, in a first section of the tilting element 11, which, with respect to a plane with the rod axis 10*a*1 and a normal vector perpendicular to the tilting axis A1, opposes a second section of the tilting element 11 in which the tilting element 11 is rotatably coupled to the arm element 10*b*. The crane eye KOE is arranged in the first section of the tilting element 11 in which the support section 11*a* is arranged. The tilting element 11 has two legs oriented in the X direction and spaced in the Z direction, so that the arm element 10*b* can be arranged between the legs of the tilting element 11. This design achieves a flat form with low material effort for the tilting element 11, providing high stability and low height for the tilting element 11. This design also allows the joint axis A2 to be used not only to couple the tilting element 11 to the piston end section 6*a* but also to couple an end section of the arm element 10*b* to the piston end section 6*a*.

Figure 3:
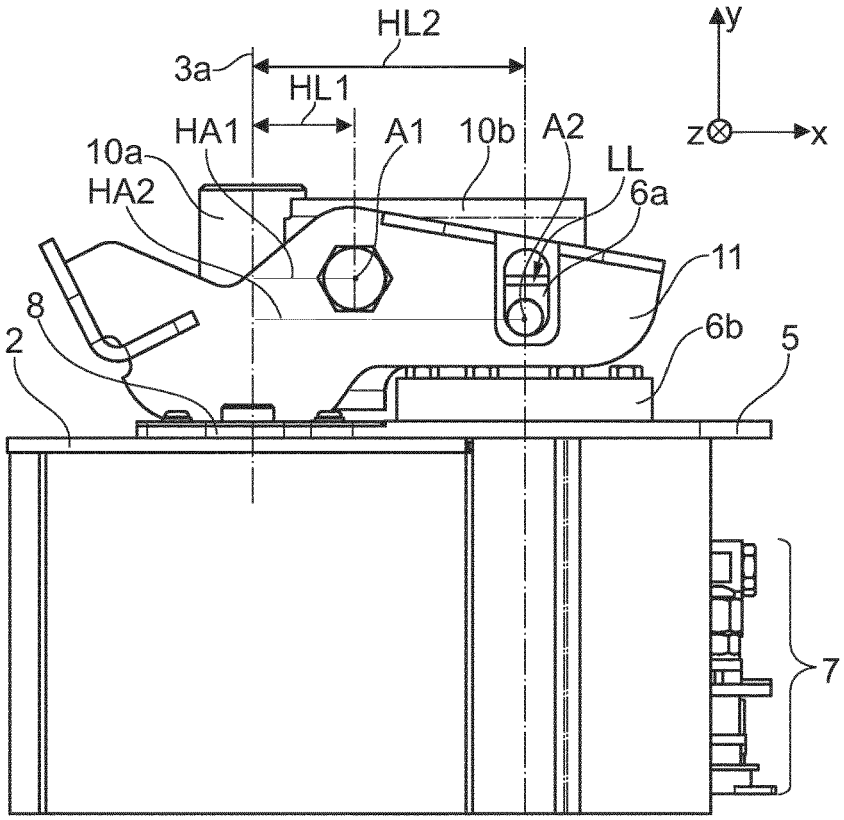
FIG. 3 shows a side view of the unboarding device according to the invention combined with a cross-sectional view of a tilting element of the second unboarding element of an arm of the unboarding device in a side view of a section of an arm of the second unboarding element with a slot.

In FIG. 3, a side view of the unboarding device 1 combined with a cross-sectional view of the tilting element 11 is shown to display a side view of a section of the arm 10 with a slot LL oriented in the Y direction. The piston end section 6*a* is fully retracted into the cylinder section 6*b* of the lifting device 6, so that the pin element SI forming the joint axis A2 rests against a lower edge in the negative Y direction of the slot LL. A first lever arm HA1 perpendicular to the rod axis 3*a*, oriented in the Y direction, and the tilting axis A1, oriented in the Z direction, extends between the rod axis 3*a* and the tilting axis A1 with a first lever arm length HL1 that is smaller than a second lever arm length HL2 of a second lever arm HA2 extending between the rod axis 3*a* and the joint axis A2, perpendicular to the rod axis 3*a* and the joint axis A2. When the piston end section 6*a* is fully retracted into the cylinder section 6*b*, as shown in FIG. 3, the support section 11*a* rests against the wear layer element 8, so that an outer surface of the support section 11*a* facing the wear layer element 8 is parallel to an outer surface of the wear layer element 8 facing the support section 11*a*. When the piston end section 6*a* moves away from the cylinder section 6*b* in the Y direction, the tilting element 11 is first rotated counterclockwise relative to the arm element 10*b*, with the arm element 10*b* and thus the arm 10 remaining stationary due to the path not traversed by the pin element SI in the slot LL. Only when the piston end section 6*a* rests against an upper edge of the slot LL in the Y direction, the arm element 10*b* and thus the arm 10 are moved in the Y direction by the pin element SI. The force introduction into the tension/compression rod 3 occurs in the unboarding device 1 shown in FIG. 3 such that initially during an unboarding operation, the force is introduced by a tilting movement of the tilting element 11 relative to the arm 1*o* using the first lever arm HA1 with the first lever arm length HL1, and subsequently, when the slot LL is traversed by the pin element SI, the force introduction occurs not through the tilting element 11 but through the arm 10 into the tension/compression rod 3 using the extended second lever arm HA2 with a lever arm length HL2 greater than the first lever arm length HL1. With essentially constant lifting force over the lifting movement of the piston end section 6*a* in the Y direction, initially a small first lever arm HA1 with high force introduction into the tension/compression rod 3 is provided to break away the corner formwork element from the concrete during unboarding, and after breaking away the corner formwork element from the concrete, the force introduction automatically shifts to the arm 1*o* using the extended second lever arm HA2 with lower force introduction into the tension/compression rod 3. This allows the lifting device 6 to be used for a load-optimized, automatically controlled lever arm adjustment during the unboarding process. The effect of an initially small lever arm during an unboarding operation and a subsequent large lever arm during the continued lifting movement for unboarding can also be present in an embodiment where the arm 10 is not connected to the tilting element 11 via a slot LL oriented in the direction of the lifting movement. As soon as the tilting element 11 no longer rests with its support section 11*a* on the corner base element 2 to introduce the lifting force into the tension/compression rod 3 using the lever arm HA1, but the tilting element 11 is lifted from the corner base element 2 during the continued lifting movement in the Y direction for unboarding, the subsequent force introduction occurs not through the first lever arm HA1 but through the second lever arm HA2. Thus, an embodiment in which the arm 10 has a slot LL oriented in the direction of the lifting movement for unboarding is not essential to the invention. Instead, the tilting element 11 can be designed to be coupled only to the arm 10 around the tilting axis A1 and to the piston end section 6*a* around the joint axis A2. Instead of using a slot LL in the arm 10, the tilting element 11 can be designed so that after completing a tilting movement by a predetermined angle, a section of the tilting element 11 rests against the arm 10, preventing further tilting movement. During continued lifting movement in the Y direction for unboarding, the force introduction then occurs through the extended second lever arm HA2 and the arm 10, as the smaller first lever arm HA1 can no longer introduce force into the tension/compression rod 3. Using the extended second lever arm HA2 after breaking the corner formwork element from the concrete with the smaller first lever arm HA1 provides a lower force introduction into the tension/compression rod 3, allowing the unboarding process to occur without permanent deformations of the corner base element 2 and/or the arm 10. Even during the initial breaking away of the corner base element 2 of the corner formwork element from the concrete using the first lever arm HA1, permanent deformation of the corner base element 2 can be avoided or at least reduced compared to the prior art by a rim of the support section 11*a* of the tilting element 11 facing the rod element 10*a* bordering without contact at a distance to an outer side of the rod element 10*a*, allowing the outer side of the rod element 10*a* to move past the rim of the support section 11*a* without friction.

Figure 4A:
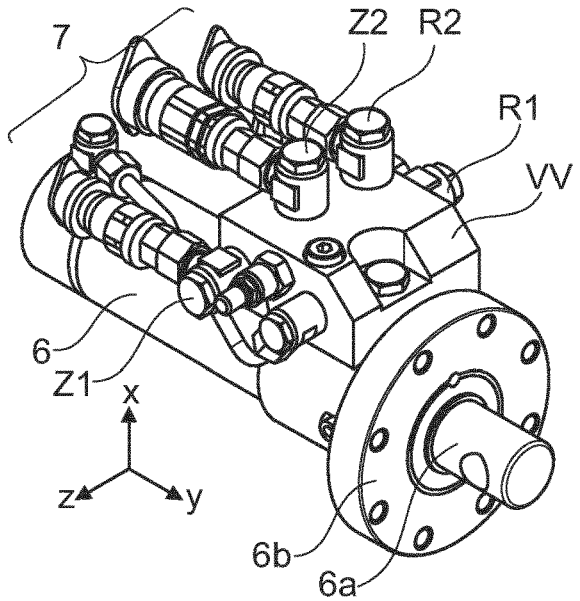
FIG. 4*a, b* show a spatial exterior view (a) of a lifting device, a valve device, and a connection unit of the unboarding device according to the invention (a) and a valve diagram (b) of the valve device for connecting the lifting device to a hydraulic unit.
Figure 4B:
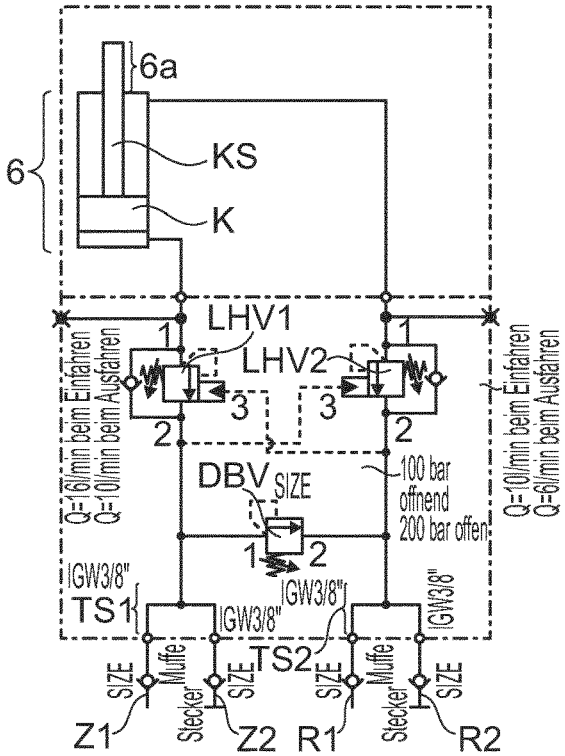

In FIG. 4*a*, a spatial exterior view of the lifting device 6, the valve device VV, and the connection unit 7 of the unboarding device 1 is shown. In the Z direction, a first inlet connection Z1 and in the negative Z direction, a first return connection R1 are led out of the valve device VV. A second inlet connection Z2 and a second return connection R2 are also led out of the valve device VV in the X direction, with the second inlet and return connections spaced in the Z direction. The connections Z1 Z2 R1 R2 are led along the valve device VV in the negative Y direction, so that in the mounted state of the first unboarding element 1*a* on the second unboarding element 1*b* and/or on a formwork element or the corner formwork element, the connection of inlet and return lines along the tension/compression rod 3 can occur in the Y direction, resulting in low construction space for the inlet and return lines. The valve device VV and the connection unit 7 with the inlet connections Z1 Z2 and the return connections R1 R2 form a "valve backpack" that can be attached in the negative X direction to the lifting device 6. The valve device VV and the connection unit 7 are arranged in the negative Y direction below the cylinder section 6*b* on the lifting device 6, so that the valve device VV can rest flush against the lifting device 6 with a surface facing the lifting device 6. In FIG. 4*b*, a valve diagram of the valve device VV for connecting the lifting device 6 to a hydraulic unit is shown. Between the (not shown) hydraulic unit and the lifting device 6, the valve device VV is connected so that cylinder- and piston-side load-holding valves LHV1 LHV2 and a piston-side pressure relief valve DBV are connected between the lifting device 6 with a piston K and a piston rod KS and the hydraulic unit. The load-holding valves LHV1 LHV2 are connected so that during both the unboarding movement to detach the formwork element from the concrete wall and the boarding movement to precisely set the formwork according to the plan, the hydraulic cylinder of the lifting device 6 remains in its respective lift position independent of external events, such as a stop of the hydraulic unit, a pressure loss in a hydraulic line, or an external load impact. This prevents uncontrolled movements of the formwork element or the corner formwork element, saving energy and increasing work safety. The pressure relief valve DBV is connected so that if the applied oil pressure exceeds the allowable operating level, for example, 190 bar, the excess pressure is automatically diverted from the inlet line ZL1 or ZL2 to the return line with the return connections R1 R2 without damaging connected components, such as the lifting device 6 itself. The pressure relief valve DBV thus provides an overload protection function for the lifting device 6. The valve device VV is connected to the hydraulic unit via a first pair of couplings with the inlet connections Z1 Z2 and a second pair of couplings with the return connections R1 R2. T-pieces TS1 for the first coupling pair and TS2 for the second coupling pair are integrated into the valve device VV, allowing simple standard hoses to be connected and disconnected by means of for example quick acting fastener instead of specially configured hydraulic ring lines with branches when using multiple unboarding devices 1.

Figure 5A:
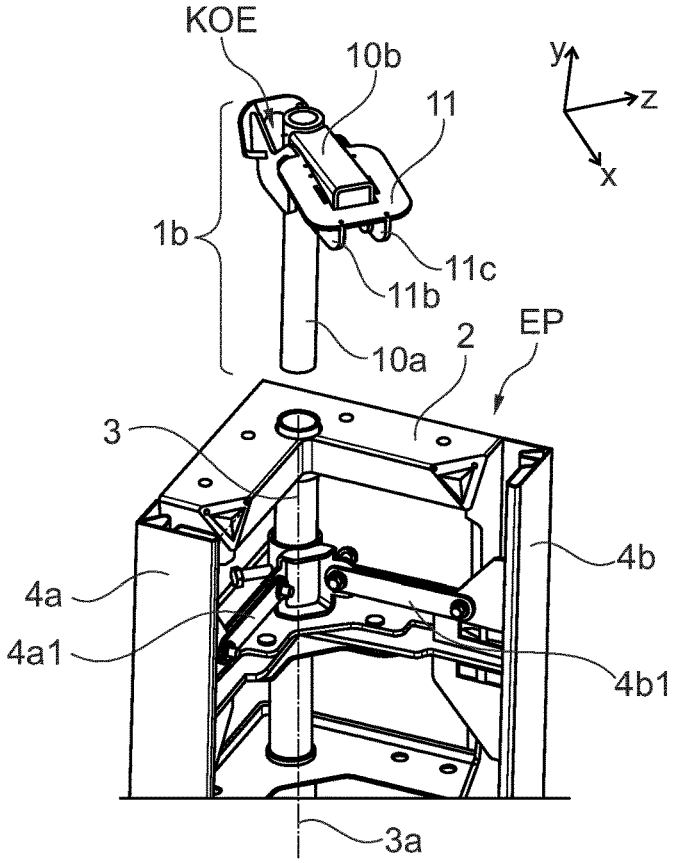
FIGS. 5*a-d* show spatial exterior views of assembly steps for mounting the unboarding device shown in FIG. 1 into the corner formwork element with the boarding/unboarding elements in the boarding position for unboarding the corner formwork element.
Figure 5B:
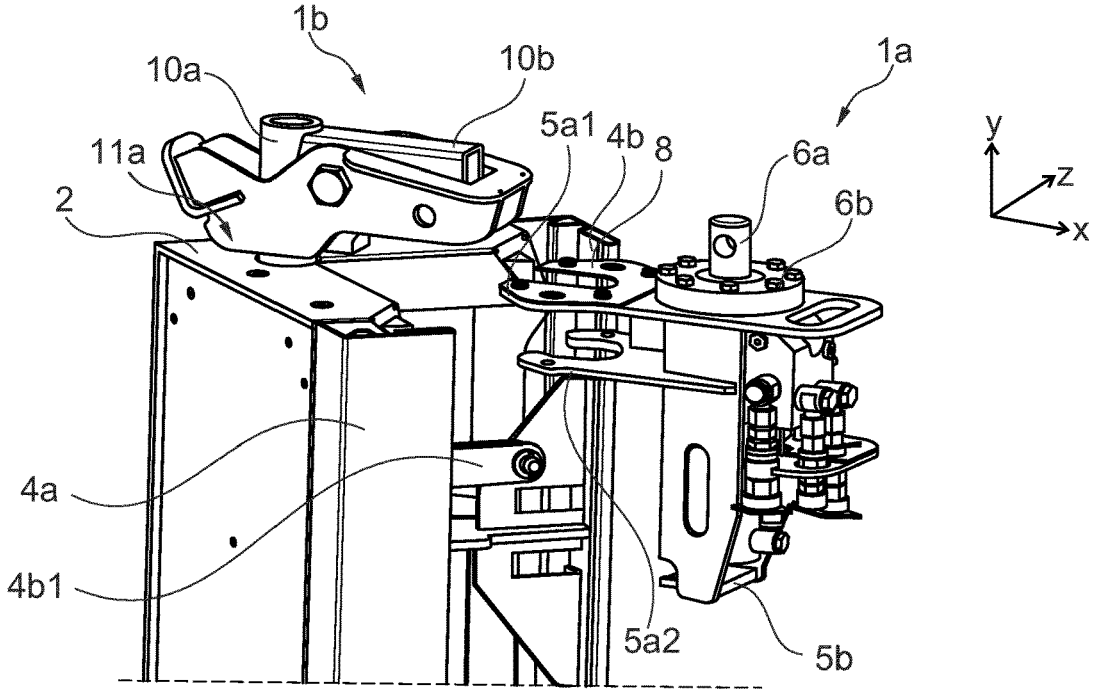
Figure 5C:
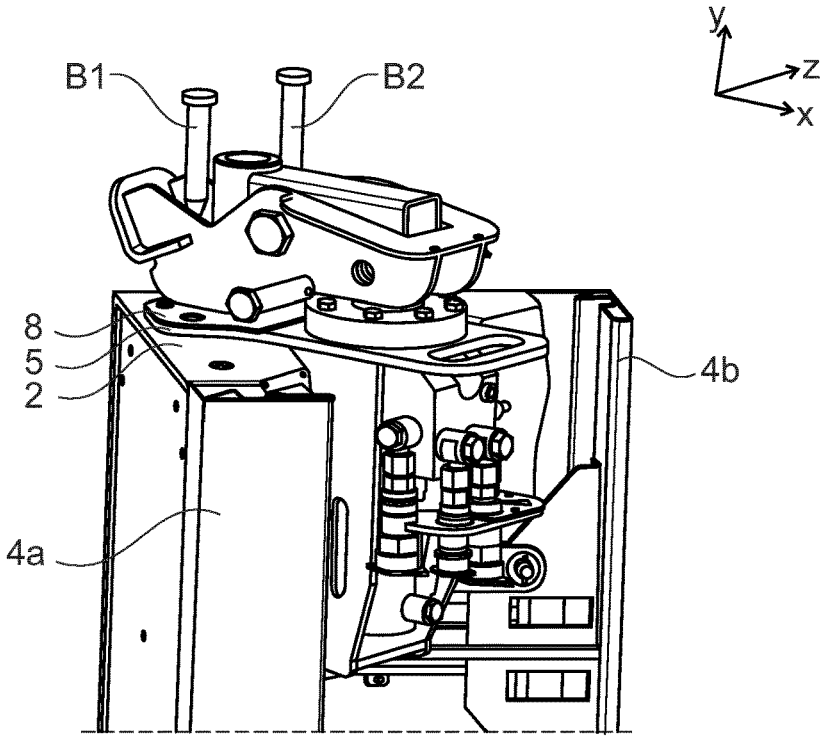
Figure 5D:
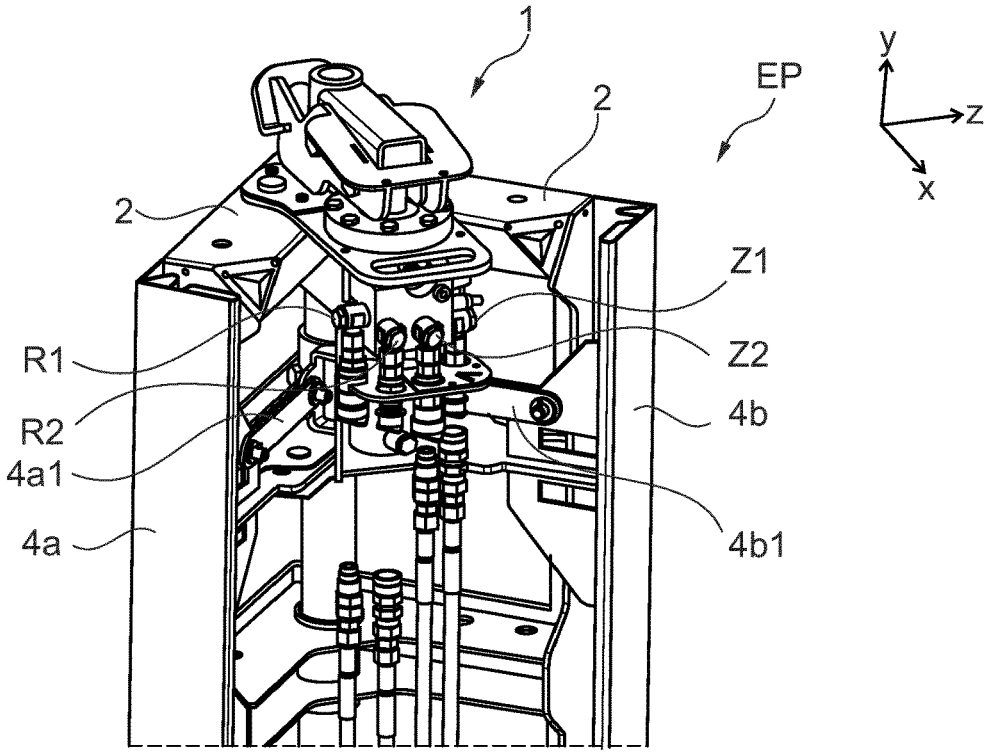

In FIGS. 5*a* to 5*d*, spatial exterior views of assembly steps for mounting the unboarding device 1 shown in FIG. 1 into the corner formwork element with the boarding/unboarding elements 4*a* 4*b* in the boarding position BP for unboarding the corner formwork element are shown. In FIG. 5*a*, the corner formwork element with the corner base element 2 and the boarding/unboarding elements 4*a* 4*b* is in the boarding position BP, such that joint levers 4*a*1 4*b*1 are oriented perpendicular to the tension/compression rod 3 with the rod axis 3*a*. The second unboarding element 1*b* with the rod element 10*a*, the arm element 10*b*, the tilting element 11 with legs 11*c* 11*b* oriented in the X direction is arranged above an outer surface of the corner base element 2. The rod axis 3*a* runs parallel to the rod axis 10*a*1 of the rod element 10*a* and coaxially thereto. In FIG. 5*b*, the second unboarding element 1*b* is inserted into the corner base element 2, so that the rod element 10*a* is inserted into the end section 3*b* of the tension/compression rod 3 and attached to introduce a force in the Y direction into the tension/compression rod 3. The first unboarding element 1*a* with the piston end section 6*a* and the cylinder section 6*b* is arranged relative to the second unboarding element 1*b*, so that during a movement in the negative X direction, the wear layer element 8 can rest directly or with a gap against the support section 11*a* of the tilting element 11. Furthermore, the upper contact element section 5*a*1, the lower contact element section 5*a*2, and the contact element end section 5*b* can engage with the corner formwork element, so that an end section of the arm element 10*b* can be connected to the piston end section 6*a*. In FIG. 5*c*, two bolts B1 B2 oriented in the Y direction are shown, inserted through recesses in the wear layer element 8, the upper contact element section 5*a*1, and the lower contact element section 5*a*2 (concealed by the corner base element 2), and then secured, for example, with retaining rings or pins, to attach the first unboarding element 1*a* to the corner formwork element. The support section 11*a* of the tilting element 11 can now support itself on the wear layer element 8 when the piston end section 6*a* moves in the Y direction to unboard the corner formwork element. In FIG. 5*d*, the first unboarding element 1*a* mounted on the outer surface of the corner base element 2 with a normal vector in the Y direction is shown, with the second unboarding element 1*b* connected to it, and the corner formwork element is in the boarding position BP. The contact element 5 is attached to the corner base element 2 with the bolts B1 B2 oriented in the Y direction. The inlet connections Z1 Z2 and the return connections R1 R2 are oriented with their ends in the negative Y direction, allowing corresponding inlet and return lines to be slid onto the inlet connections Z1 Z2 and the return connections R1 R2 in the Y direction and connected. Since the unboarding process has not yet begun, the joint levers 4*a*1 4*b*1 are still oriented perpendicular to the tension/compression rod 3, so that the boarding/unboarding elements 4*a* 4*b* are fully extended relative to the corner base element 2.

Figure 6:
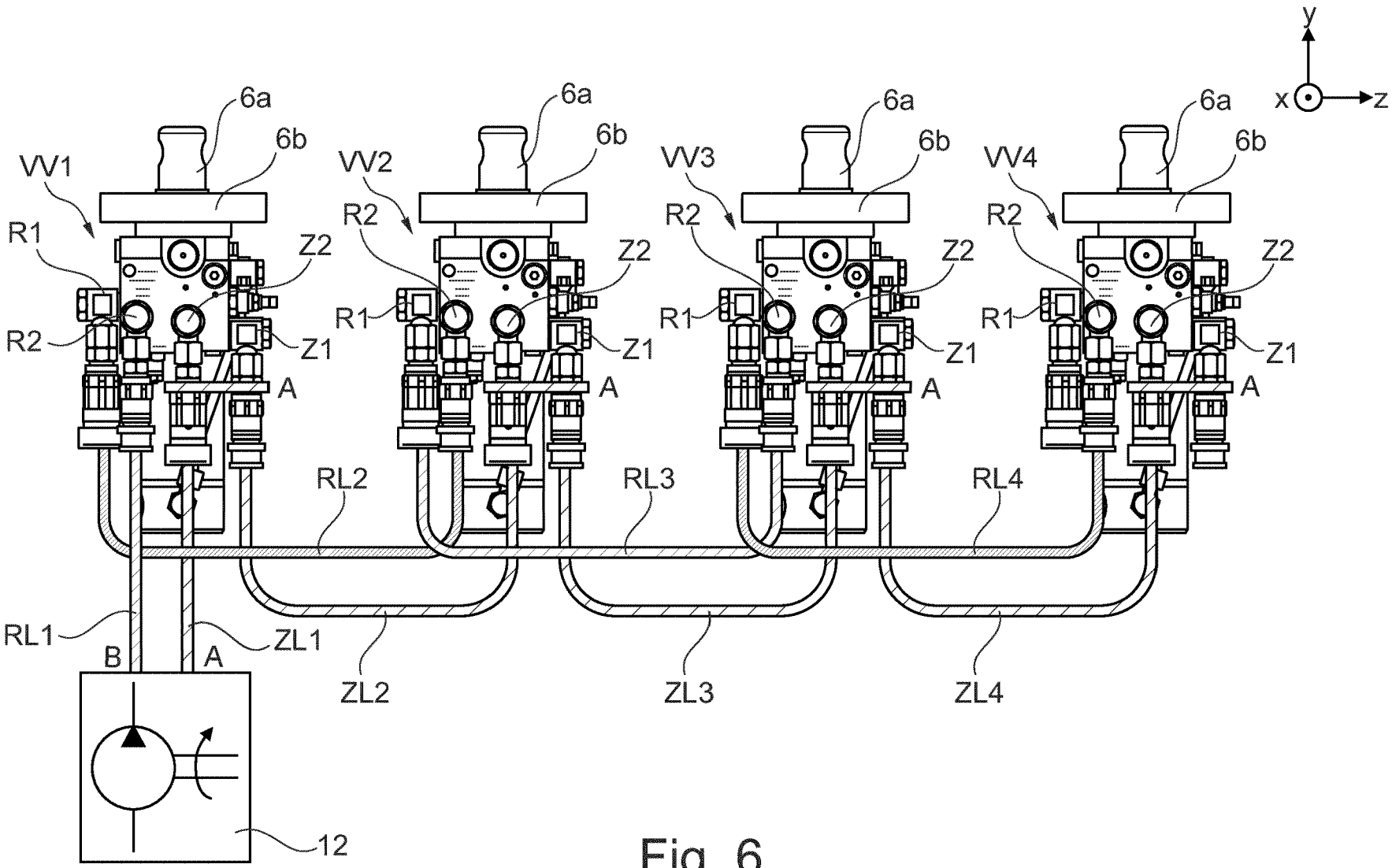
FIG. 6 shows a connection diagram for connecting a hydraulic unit to four valve devices each shown in FIG. 4*a*.

In FIG. 6, a connection diagram for connecting a hydraulic unit 12 to four valve devices VV, each shown in FIG. 4*a*, is displayed. At the start of mounting the inlet and return lines to the corresponding inlet and return connections, no lines are connected. The four valve devices VV shown in FIG. 6 are subsequently referred to from left to right as valve device 1, 2, 3, and 4. First, the hydraulic unit 12 is connected to the inlet connection Z2 of the first valve device via the inlet line ZL1. Then, the inlet connection Z1 of the first valve device is connected to the inlet connection Z2 via the inlet line ZL2. Then, the inlet connection Z1 of the second valve device is connected to the inlet connection Z2 of the third valve device via the inlet line ZL3. Then, the inlet connection Z1 of the third valve device is connected to the inlet connection Z2 of the fourth valve device via the inlet line ZL4. Now, the hydraulic unit is connected to the return connection R2 of the first valve device via the return line RL1. The first return connection R1 of the first valve device is connected to the second return connection of the second valve device via the return line RL2, and then the first return connection of the second valve device is connected to the second return connection of the third valve device via the return line RL3. Finally, the first return connection R1 of the third valve device is connected to the second return connection of the fourth valve device via the return line RL4. The connection diagram shown in FIG. 6 for connecting four valve devices with attached lifting devices 6 represents an uncontrolled ring-shaped supply line of the individual lifting devices. The oil volume provided by the hydraulic unit 12 is thus free in deciding in which lifting device pressure is built up first. According to the principle of least resistance, initially the formwork elements with lower resistance are unboarded until finally, the maximum oil pressure (with the highest efficiency) is available for the formwork elements with higher adhesion. Therefore, the ring-shaped supply line shown in FIG. 6 provides a load-optimized, uncontrolled oil supply for unboarding multiple formwork elements/corner formwork elements.

Figures 7C, 7D:
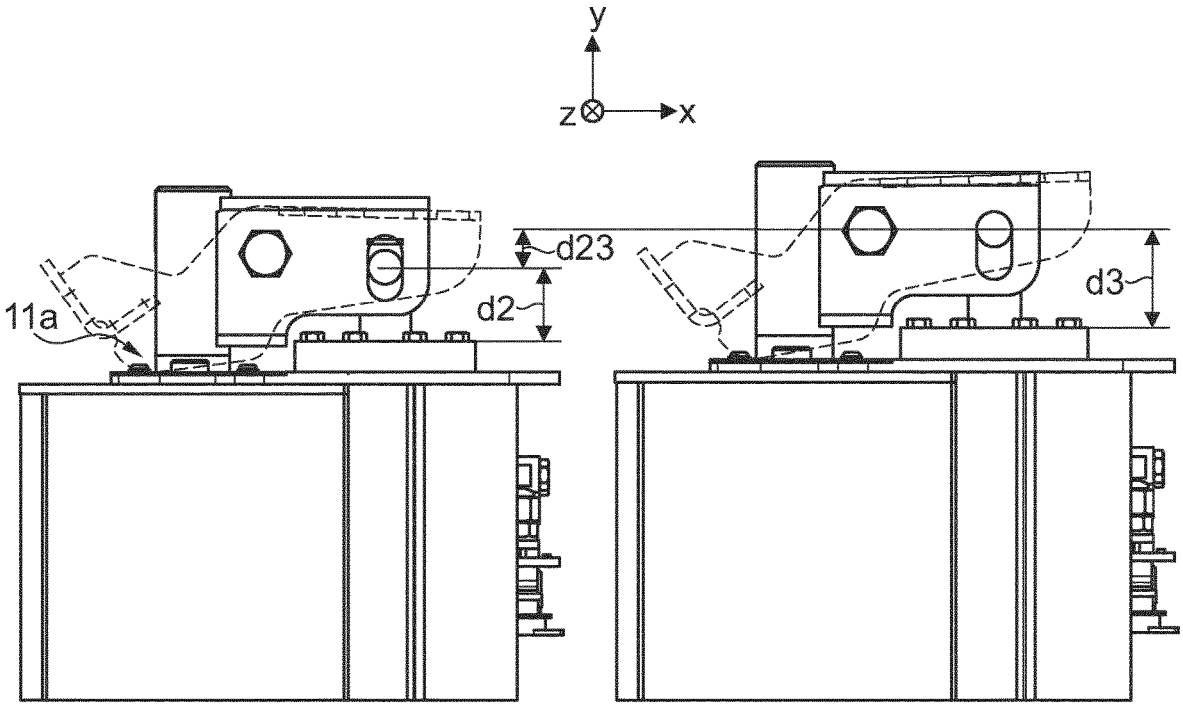
Figures 7C, 7D:
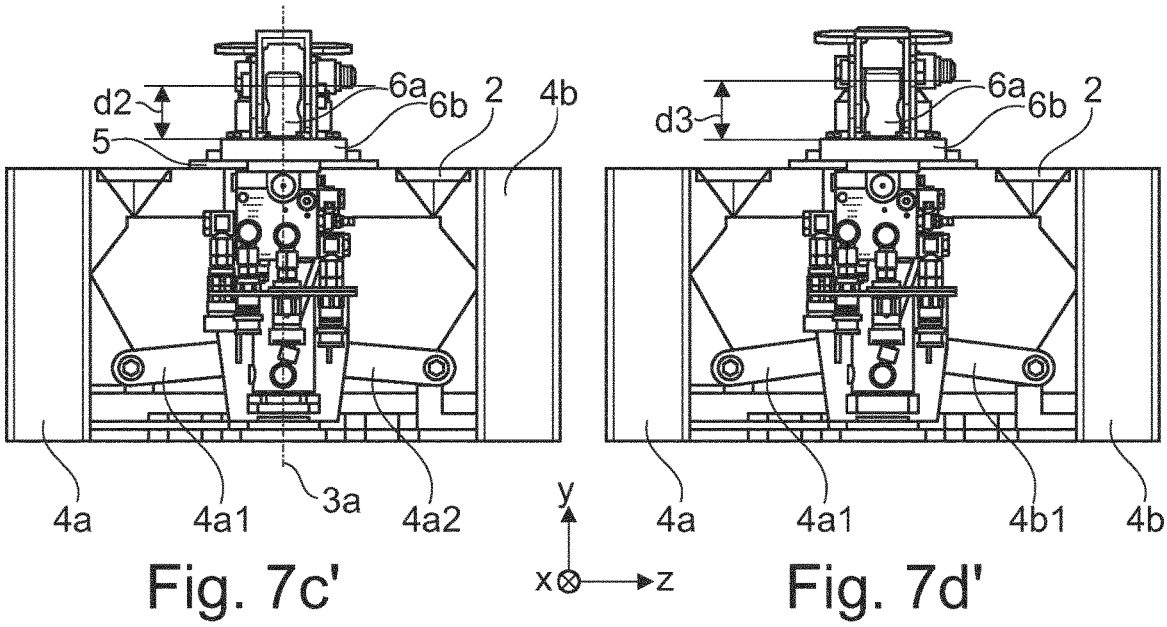

FIGS. 7*a* to 7*h* show side views of the unboarding devices 1 mounted on the corner formwork element with a dashed tilting element 11, showing the side view of the arm 10 during a movement sequence of the lifting device 6 for unboarding the corner formwork element. Below each of the FIGS. 7*a* to 7*h*, FIGS. 7*a*' to 7*h*' are shown, displaying front views of the unboarding devices 1 mounted on the corner formwork element corresponding to the side views shown in FIGS. 7*a* to 7*h* during the movement sequence of the lifting device 6 for unboarding the corner formwork element with exterior views of joint levers 4*a*1, 4*b*1 coupled to the tension/compression rod 3 in different positions relative to the tension/compression rod 3. At the beginning of the unboarding process, the corner formwork element is in the boarded state, so the boarding/unboarding elements 4*a*, 4*b* are extended relative to the corner base element 2 into the boarding position BP. Therefore, the joint levers 4*a*1, 4*b*1 are oriented perpendicular to the rod axis 3*a* of the tension/compression rod 3. The initial distance between the joint axis A2 and an upper edge of the cylinder section 6*b* do is defined by the fact that the piston end section 6*a* forming the joint axis A2 is fully retracted into the cylinder section 6*b*. The pin element SI forming the joint axis A2 is positioned in the negative Y-direction against a lower edge of the slot LL oriented in the Y-direction of the arm element 10*b* of the arm 10. In FIGS. 7*b*, the distance d1 between the joint axis A2 and the upper edge of the cylinder section 6*b* is greater than the distance do shown in FIG. 7*a*. The support section 11*a* rests against the wear layer element 8 in such a way that a lifting force due to the movement of the piston end section 6*a* away from the cylinder section 6*b* can be introduced into the tension/compression rod 3 by the first lever arm HA1, as shown in FIG. 3. Due to the movement of the tension/compression rod 3 in the Y-direction, the joint levers 4*a*1, 4*b*1 have an angle greater than a right angle relative to a section of the tension/compression rod 3 positioned between the joint levers 4*a*1, 4*b*1 and the tilting element 11. FIGS. 7*c*, 7*c*' show the unboarding device 1 in a state where the piston end section 6*a* has moved away by a distance d2 between the joint axis A2 and the upper edge of the cylinder section 6*b*, which is greater than the distance d1 shown in FIGS. 7*b*, 7*b*'. The lifting movement is introduced into the tension/compression rod 3 by the first lever arm HA1 shown in FIG. 3, with the tilting element 11 supporting itself on the wear layer element 8 and thus on the corner base element 2 through its support section 11*a*. The lifting force is not introduced through the arm element 10*b* by the second lever arm HA2 because the pin element SI is positioned centrally within the slot LL, preventing the transfer of force from the piston end section 6*a* to the arm element 10*b*. The joint levers 4*a*1, 4*b*1 take on a greater angle relative to the section of the tension/compression rod 3 positioned between the joint levers 4*a*1, 4*b*1 and the tilting element 11 compared to FIG. 7*b*'. Comparing FIGS. 7*d*, 7*d*' with FIGS. 7*c*, 7*c*' shows that the distance between the joint axis A2 and the upper edge of the cylinder section d3 is greater by a difference d23 than the distance d2 between the joint axis A2 and the upper edge of the cylinder section. Since the pin element SI has not yet reached the upper edge of the slot LL in the Y-direction, the first lever arm HA1 is still used to introduce the lifting force into the tension/compression rod 3. In the state of the unboarding device 1 shown during unboarding in FIGS. 7*e*. 7*e*', the distance d4 between the joint axis A2 and the upper edge of the cylinder section 6*b* is greater than the distance d3 shown in FIG. 7*d*, but the lifting force is still introduced through the first lever arm HA1 by the lifting movement directed in the Y-direction. The support section 11*a* of the tilting element 11 still rests against the wear layer element 8 in such a way that the lifting force can be introduced into the tension/compression rod 3 by the first lever arm HA1. This is different from the state of the unboarding device 1 shown in FIGS. 7*f*, 7*f*'. A distance d5*l* between the support section 11*a* and the wear layer element 8 indicates that the tilting element 11 can no longer support itself on the corner base element 2 through the support section 11*a* to introduce the lifting force into the tension/compression rod 3 by the first lever arm HA1. Instead, the pin element SI now rests against an upper edge of the slot LL of the arm element 10*b*, so that the lifting force introduced from the piston end section 6*a* into the arm element 10*b* through the pin element SI is introduced into the tension/compression rod 3 by the second lever arm HA2.

The breaking away of the corner formwork element with the corner base element 2 from an adjacent concrete layer is completed, and instead of the first lever arm HA1 with a higher force, the extended second lever arm HA2 relative to the first lever arm HA1 is now used to provide a smaller force compared to the first lever arm HA1 for unboarding the corner formwork element. During the transition of the distance from the joint axis A2 to the upper edge of the cylinder section d4 to the distance d5, a transition occurs from introducing the lifting force of the lifting device 6 into the tension/compression rod 3 from the first lever arm HA1 to the second, longer lever arm HA2 compared to the first lever arm HA1. The distance d6 between the joint axis A2 and the upper edge of the cylinder section of the lifting device 6 is greater than the distance d5 shown in FIG. 7*f* between the joint axis A2 and the upper edge of the cylinder section, with the increase in distance from d5 to d6 resulting in a corresponding increase in distance d6*i* between the support section 11*a* and the wear layer element 8. FIGS. 7*h*, 7*h*' show a distance d7 between the joint axis A2 and the upper edge of the cylinder section of the lifting device 6 that is greater by the difference d67 than the distance d6 between the joint axis A2 and the upper edge of the cylinder section. The state of the unboarding device 1 shown in FIG. 7*h* and FIG. 7*h*' indicates that the piston end section 6*a* is fully extended from the cylinder section 6*b*, and the corner formwork element is in the unboarded state, with the boarding/unboarding elements 4*a*, 4*b* fully retracted relative to the tension/compression rod 3. An angle between the joint levers 4*a*1, 4*b*1 and the section of the tension/compression rod 3 between the joint levers 4*a*1, 4*b*1 and the tilting element 11 is approximately 135°, so that the boarding/unboarding elements 4*a*, 4*b* are fully retracted toward the tension/compression rod 3.

Figure 8C:
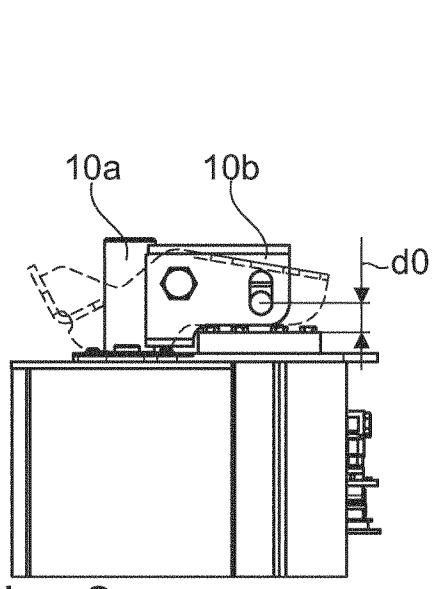
FIGS. 8*a-c* show side views of the unboarding device mounted on the corner formwork element with a dashed tilting element to a side view of the arm of the second unboarding element in a movement sequence of the lifting device for boarding the corner formwork element.
Figure 8B:
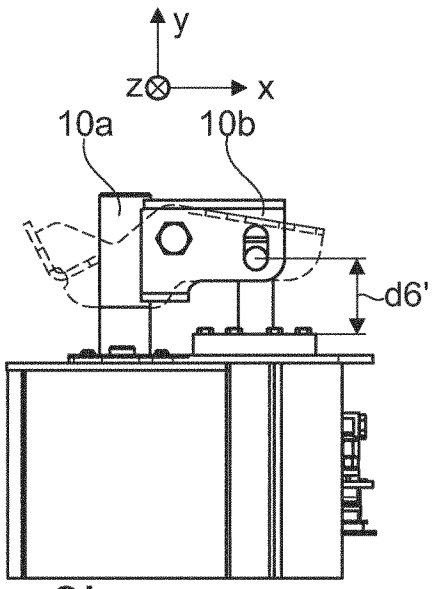
Figure 8A:
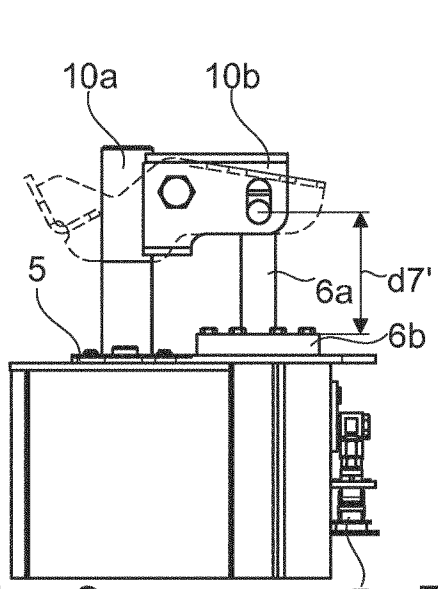
Figure 8C:
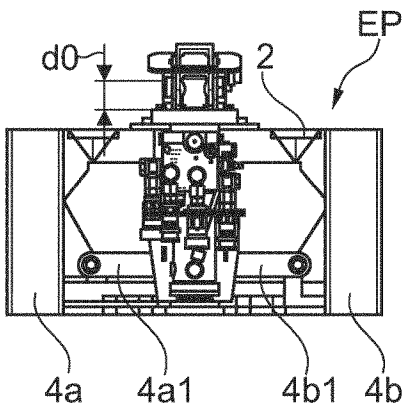
Figure 8B:
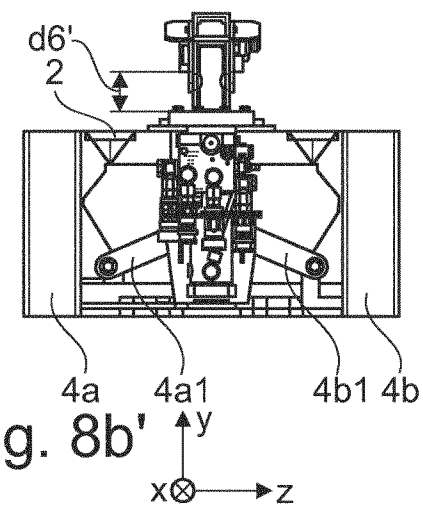
Figure 8A:
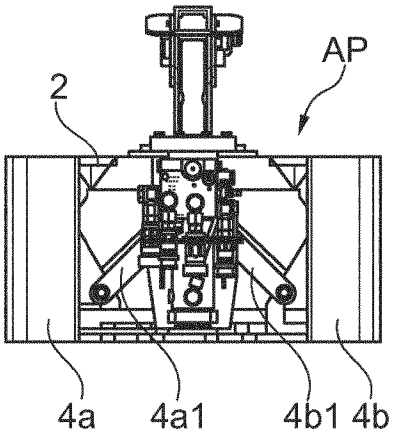

FIGS. 8*a* to 8*c* show side views of the unboarding device 1 mounted on the corner formwork element with a dashed tilting element 11 showing the side view of the arm 10 during a movement sequence of the lifting device 6 for boarding the corner formwork element. FIGS. 8*a*' to 8*c*' are each arranged below FIGS. 8*a* to 8*c* and show front views of the unboarding device 1 mounted on the corner formwork element corresponding to the side views shown in FIGS. 8*a* to 8*c* during the movement sequence of the lifting device 6 for boarding the corner formwork element with exterior views of joint levers 4*a*1, 4*b*1 in different positions relative to the tension/compression rod 3. Initially, the corner formwork element with the corner base element 2 is in the unboarded state, with the boarding/unboarding elements 4*a*, 4*b* fully retracted relative to the corner base element 2 and the tension/compression rod 3. The distance between the joint axis A2 and the upper edge of the cylinder section d7' is smaller than the distance d7 shown between the joint axis A2 and the upper edge of the cylinder section in FIGS. 7*h*, 7*h*' by the travel of the pin element SI from the upper edge of the slot LL to the lower edge of the slot LL. Due to the movement of the piston end section 6*a* in the negative Y-direction, the arm 10 is carried by the piston end section 6*a* through the pin element SI at the lower edge of the slot LL, so the second lever arm HA2 is used to introduce the lifting force into the tension/compression rod 3. This is also the case in the state of the unboarding device 1 shown in FIGS. 8*b*, 8*b*', with the corner formwork element positioned between the unboarded state and the boarded state as shown in FIG. 7*g*'. Due to the carrying of the arm 10 at the lower edge of the slot LL, the distance between the joint axis A2 and the upper edge of the cylinder section during boarding is not the distance d6 but the distance d6', which is smaller by the travel of the pin element SI from the upper edge of the slot LL to the lower edge of the slot LL. Finally, FIGS. 8*c*, 8*c*' show the corner formwork element in the boarded state, indicated by the joint levers 4*a*1, 4*b*1 oriented perpendicular to the tension/compression rod 3, with the boarding/unboarding elements 4*a*, 4*b* fully extended relative to the tension/compression rod 3. Therefore, the state of the unboarding device 1 and the corner formwork element corresponds to the state shown in FIG. 7*a*, 7*a*'.

Figure 9A:
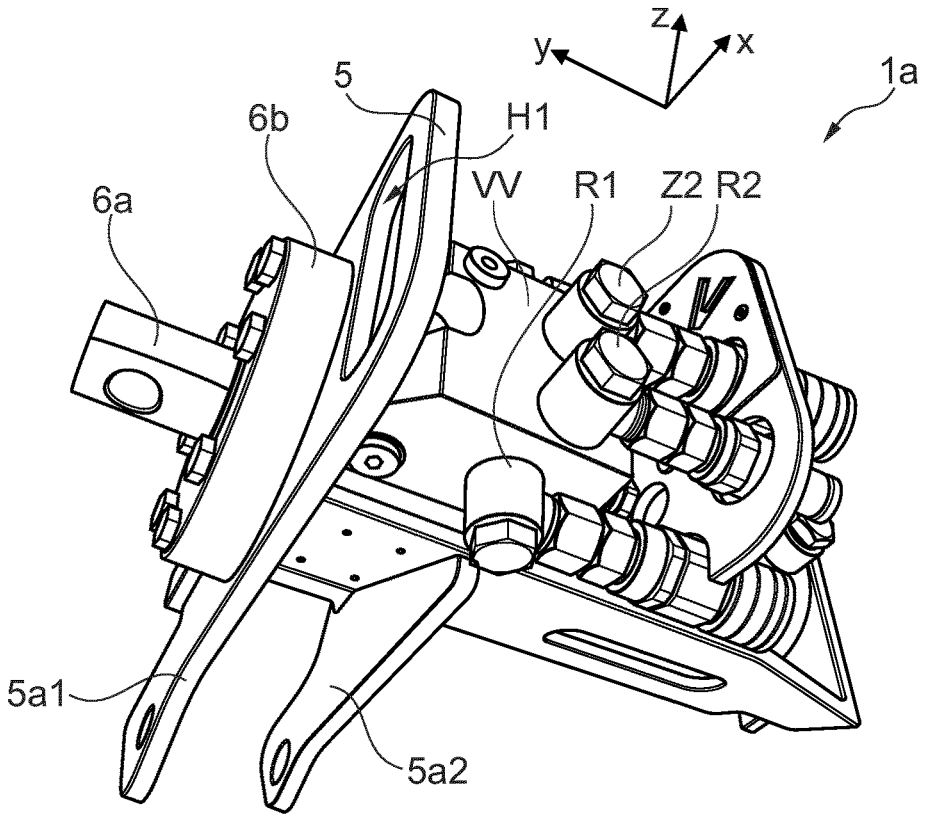
FIGS. 9*a-b* show spatial exterior views of the first unboarding element (a) and the second unboarding element (b) of the unboarding device according to the invention as a prototype.
Figure 9B:
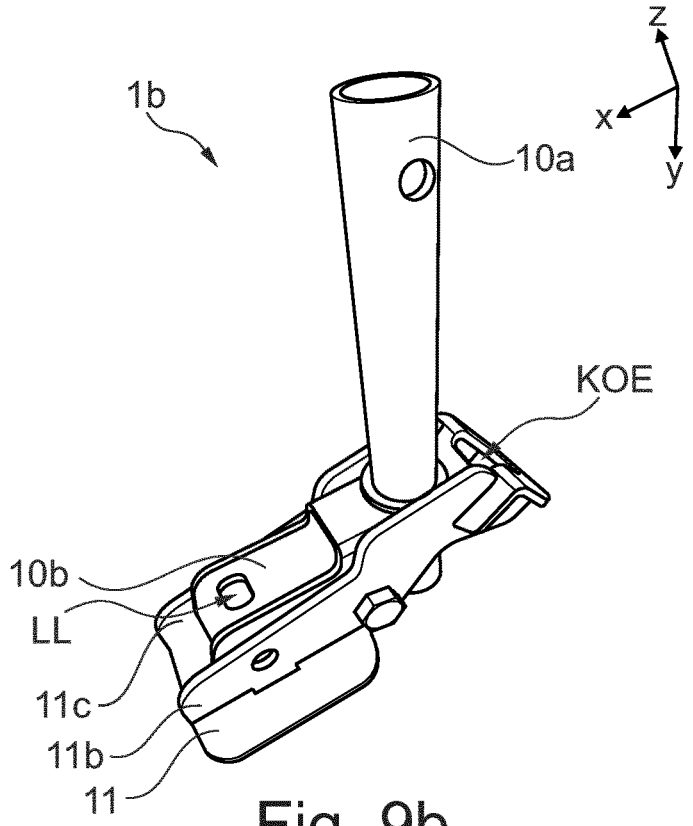

FIGS. 9*a* and 9*b* show spatial exterior views of the first unboarding element 1*a* and the second unboarding element 1*b* of the unboarding device 1 as prototypes. In FIG. 9*a*, the piston end section 6*a* is extended in the Y-direction from the cylinder section 6*b* and features a cylindrical recess in the X-direction to accommodate the pin element SI. The lower contact element section 5*a*2 is arranged parallel to and spaced from the upper contact element section 5*a*1 of the contact element 5 in the Y-direction. The valve device W with the inlet connection Z2 and the return connections R1, R2 is oriented in the Y-direction and arranged as a "valve backpack" directly on the lifting device 6 to minimize the installation space of the first unboarding element 1*a*. The handle H1 is designed as a slot LL oriented in the Z-direction, adjacent to the cylinder section 6*b*, and thus space-savingly arranged on the first unboarding element 1*a*. In FIG. 9*b*, the second unboarding element 1*b* is shown as a prototype, with the crane eye KOE in the form of a recess in the tilting element 11 oriented in the negative X-direction. The slot LL is present in the arm element 10*b* as a recess oriented in the negative Y-direction. The rod element 10*a* is designed as a hollow cylindrical body with a round recess for accommodating a bolt to attach to the rod end section 3*b* and welded to the arm element 10*b* arranged perpendicular to the rod element 10*a*. The tilting element 11 features parallel legs 11*b*, 11*c* oriented in the X-direction and spaced from each other in the Z-direction, allowing the arm element 10*b* and the rod element 10*a* to be arranged friction-free between the legs 11*c* and 11*b*. The tilting element 11 is coupled to the arm element 10*b* by a bolt defining the tilting axis A1.

The features of the invention described with reference to the illustrated embodiment, such as the use of a first pair of couplings for inlet lines and a second pair of couplings for return lines with T-pieces integrated into the valve device, can also be present in other embodiments of the invention, such as the use of the first and second coupling pairs with T-pieces integrated into the inlet and return lines, unless otherwise stated or technically impossible.

REFERENCE LIST

1 unboarding device
1*a* first unboarding element
1*b* second unboarding element
2 base element, corner base element
3 tension/compression rod
3*a* rod axis
3*b* rod end section
4*a*, 4*b* boarding/unboarding element
4*a*1, 4*b*1 joint lever
5 contact element
5*a*1 upper contact element section
5*a*2 lower contact element section
5*b* contact element end section
6 lifting device
6*a* piston end section
6*b* cylinder section
7 connection unit
8 wear layer element
10 arm
10*a* rod element
10*a*1 rod axis
10*b* arm element
11 tilting element
11*a* support section
11*b*, 11*c* tilting element legs
12 drive unit
A1 tilting axis
A2 joint axis
UP unboarding position
B1, B2 bolts
d0-d6, d6', d7, d7' distance joint axis from upper edge cylinder section
d23 difference distance d2 from distance d3
d51 distance support section from wear layer element at
d61 distance d5
d61 distance support section from wear layer element at distance d6
d67 difference distance d6 from distance d7
DBV pressure relief valve
BP boarding position
H1, H2*a*, H2*b* handle
HA1 first lever arm
HA2 second lever arm
HL1 first lever arm length
HL2 second lever arm length
K piston
KS piston rod
KOE crane eye
LHV1, LHV2 load holding valve
LL slot R1, R2 return connection
RL1-RL4 return line
SA bar element
SI pin element
TS1, TS2 T-piece
W valve device
Z1, Z2 inlet connection
ZL1-ZL4 inlet line

The invention claimed is:

1. An unboarding device for a formwork element, the formwork element including a base element, a tension/compression rod, and at least one boarding/unboarding element configured to extend or retract into a boarding or unboarding position, the at least one boarding/unboarding element coupled laterally with the base element and configured to extend or retract into the boarding or unboarding position through a linear movement of the tension/compression rod, the linear movement being essentially parallel to a rod axis relative to the base element, the unboarding device comprising:

a) a first unboarding element that includes a contact element and a cylinder section of a lifting device rigidly arranged to the contact element, the lifting device being drivable by a drive unit, wherein the contact element is designed such that a piston end section of the lifting device can move away from the base element when the cylinder section supports itself on the base element through the contact element, and b) a second unboarding element that includes an arm reversibly attachable to a rod end section of the tension/compression rod and, in the attached state, extending from the tension/compression rod, and a tilting element rotatably coupled to the arm around a tilting axis, wherein the tilting element is rotatably couplable to the piston end section of the lifting device around a joint axis and is designed to be able to support itself on the base element when the piston end section moves away from the formwork element, wherein when the arm is attached to the rod end section, a first lever arm extending perpendicular to the rod axis and the tilting axis between the rod axis and the tilting axis has a first lever arm length smaller than a second lever arm length of a second lever arm extending between the rod axis and the joint axis, which second lever arm being perpendicular to the rod axis and the joint axis.

2. The unboarding device according to claim 1, wherein the arm includes a rod element reversibly attachable to the rod end section, the rod axis of the rod element being essentially coaxial or parallel to the rod axis, and an arm element extending from the rod element and rigidly connected to the rod element, to which the tilting element is rotatably coupled around the tilting axis, wherein the rod length of the rod element is chosen so that, when the arm is attached to the rod end section, the arm element and the tilting element are positioned outside the base element.

3. The unboarding device according to claim 2, wherein a lifting axis of the lifting device is essentially parallel to the rod axis and the lifting device is spaced from the rod element by essentially the second lever arm length, so that the first unboarding element and the second unboarding element form a U-shape.

4. The unboarding device according to claim 1, wherein, when the arm is attached to the rod end section, the tilting element includes a support section for supporting on the base element in a first section of the tilting element, which, with respect to a plane with the rod axis and a normal vector perpendicular to the tilting axis, opposes a second section of the tilting element in which the tilting element is rotatably coupled to the arm around the tilting axis.

5. The unboarding device according to claim 4, wherein a rim of the support section of the tilting element facing the rod element is spaced without contact at least partly from an outer side of the rod element facing the rim, with such a spacing chosen so that the outer side of the rod element can move past the rim of the support section without friction.

6. The unboarding device according to claim 4, wherein the first unboarding element includes a wear layer element, the wear layer element being formed as a horseshoe-shaped plate, arranged at least between the contact element and the first section of the tilting element in the area of the support section when the tilting element is rotatably coupled to the piston end section of the lifting device around the joint axis.

7. The unboarding device according to claim 1, wherein, when the arm is attached to the rod end section, the arm extends in an area extending from the tension/compression rod to an arm end section, so that it can be coupled to the piston end section of the lifting device such that a third lever arm extending perpendicular to the rod axis between the rod axis and the piston end section of the lifting device has a third lever arm length that is greater than the first lever arm length of the first lever arm, and in case of a continued lifting movement of the lifting device in one direction, a force is introduced into the tension/compression rod essentially parallel to the rod axis for unboarding first by the tilting element into the arm using only the first lever arm and subsequently from the arm using only the third lever arm.

8. The unboarding device according to claim 7, wherein the arm in the area extending from the tension/compression rod includes a slot oriented in the direction of the lifting movement, and through the slot, a pin element coupled to the piston end section of the lifting device, wherein the pin element is a bolt, is guided, which is rotatably coupled to the tilting element around the joint axis, such that the third lever arm corresponds to the second lever arm.

9. The unboarding device according to claim 1, wherein the tilting element has the shape of a clamp with two legs, which are connected at both ends, in which the arm is arranged, wherein the tilting axis is formed by a bar element, wherein the bar element is a bolt, guided through the two legs and the arm.

10. The unboarding device according to claim 1, wherein the lifting device is designed to be driven by the drive unit in the form of a hydraulic unit, pneumatic unit, a spindle lifting gear with a rotary motor, a spindle lifting gear with an electric motor, or manually by a crank or ratchet, or by a combination thereof.

11. The unboarding device according to claim 10, wherein a valve device interposed between the hydraulic unit and the lifting device includes either cylinder- and piston-side load holding valves and a piston- or cylinder-side pressure relief valve or cylinder- and piston-side check valves and a piston- or cylinder-side pressure relief valve.

12. The unboarding device according to claim 10, wherein the valve device is connected to the hydraulic unit by a first pair of couplings for inlet lines and a second pair of couplings for return lines, with T-pieces integrated into the valve device and/or the inlet and return lines.

13. The unboarding device according to claim 1, wherein the tilting element includes a crane eye, which, when the arm is attached to the rod end section, lies in a/the first section of the tilting element, which, with respect to a plane with the rod axis and a normal vector perpendicular to the tilting axis, opposes a/the second section of the tilting element, in which the tilting element is rotatably coupled to the arm around the tilting axis, and/or the first unboarding element includes at least one handle designed as a slot oriented perpendicular to the rod axis, and/or at least one further handle designed as a slot oriented parallel to the rod axis.

14. A formwork arrangement, which includes an unboarding device according to claim 1, the base element, and the formwork element.

* * * * *